US008896235B1

(12) United States Patent
Shum et al.

(10) Patent No.: US 8,896,235 B1
(45) Date of Patent: Nov. 25, 2014

(54) HIGH TEMPERATURE LED SYSTEM USING AN AC POWER SOURCE

(71) Applicant: Soraa, Inc., Fremont, CA (US)

(72) Inventors: Frank Tin Chung Shum, Goleta, CA (US); Frank M. Steranka, Fremont, CA (US); Clifford Jue, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 0 days.

(21) Appl. No.: 13/973,213

(22) Filed: Aug. 22, 2013

Related U.S. Application Data

(63) Continuation-in-part of application No. 13/298,905, filed on Nov. 17, 2011, now Pat. No. 8,541,951.

(60) Provisional application No. 61/414,821, filed on Nov. 17, 2010, provisional application No. 61/435,915, filed on Jan. 25, 2011.

(51) Int. Cl.
*H05B 37/02* (2006.01)
*H05B 33/08* (2006.01)

(52) U.S. Cl.
CPC ..... *H05B 33/0806* (2013.01)
USPC ..... 315/309; 315/193; 315/297

(58) Field of Classification Search
USPC ..... 315/185 R, 192, 193, 201, 291, 294, 315/297, 307–309
See application file for complete search history.

(56) References Cited

U.S. PATENT DOCUMENTS

| | | | |
|---|---|---|---|
| 4,066,868 | A | 1/1978 | Witkin et al. |
| 4,350,560 | A | 9/1982 | Helgeland et al. |
| 4,581,646 | A | 4/1986 | Kubodera |
| 5,169,486 | A | 12/1992 | Young et al. |
| 6,335,771 | B1 | 1/2002 | Hiraishi |
| 6,498,355 | B1 | 12/2002 | Harrah et al. |

(Continued)

FOREIGN PATENT DOCUMENTS

| | | |
|---|---|---|
| JP | 2006-147933 | 6/2006 |
| WO | WO 2009/066430 | 5/2009 |
| WO | WO 2010/150880 | 12/2010 |
| WO | WO 2011/010774 | 1/2011 |

OTHER PUBLICATIONS

Weaver et al., 'Optical Properties of Selected Elements', Handbook of Chemistry and Physics, 94th Edition, 2013-2014, pp. 12-126-12-150.

(Continued)

*Primary Examiner* — Don Le
(74) *Attorney, Agent, or Firm* — Kilpatrick Townsend & Stockton LLP

(57) ABSTRACT

An LED lighting system powered by an AC power source comprising a rectifier module configured to provide a rectified output to a first group of LED devices and a second group of LED devices electrically coupled to the first group of LED devices. A current monitor module electrically coupled to the first group and to the second group of LED devices is configured to determine a first current level using a drawn current level signal associated with the first group of LED devices and a second current level using a reference current level signal associated with the second group of LED devices. The current monitor module is electrically coupled to a temperature sensing module that is configured to generate at least one compensation factor based at least in part on a temperature. The compensation factor is used to control (directly or indirectly) current through the LED devices.

20 Claims, 41 Drawing Sheets

(56) References Cited

U.S. PATENT DOCUMENTS

| | | | |
|---|---|---|---|
| 6,621,211 | B1 | 9/2003 | Srivastava et al. |
| 6,787,999 | B2 | 9/2004 | Stimac et al. |
| 6,853,010 | B2 | 2/2005 | Slater, Jr. et al. |
| 6,864,641 | B2 | 3/2005 | Dygert |
| 6,956,246 | B1 | 10/2005 | Epler et al. |
| 6,989,807 | B2 | 1/2006 | Chiang |
| 7,009,199 | B2 | 3/2006 | Hall |
| 7,081,722 | B1 | 7/2006 | Huynh et al. |
| 7,083,302 | B2 | 8/2006 | Chen et al. |
| 7,113,658 | B2 | 9/2006 | Ide et al. |
| 7,148,515 | B1 | 12/2006 | Huang et al. |
| 7,252,408 | B2 | 8/2007 | Mazzochette et al. |
| 7,253,446 | B2 | 8/2007 | Sakuma et al. |
| 7,279,040 | B1 | 10/2007 | Wang |
| 7,285,799 | B2 | 10/2007 | Kim et al. |
| 7,318,651 | B2 | 1/2008 | Chua et al. |
| 7,358,543 | B2 | 4/2008 | Chua et al. |
| 7,550,305 | B2 | 6/2009 | Yamagata et al. |
| 7,560,981 | B2 | 7/2009 | Chao et al. |
| 7,658,528 | B2 | 2/2010 | Hoelen et al. |
| 7,663,229 | B2 | 2/2010 | Lu et al. |
| 7,737,457 | B2 | 6/2010 | Kolodin et al. |
| 7,791,093 | B2 | 9/2010 | Basin et al. |
| 7,824,075 | B2 | 11/2010 | Maxik |
| 7,906,793 | B2 | 3/2011 | Negley |
| 7,972,040 | B2 | 7/2011 | Li et al. |
| 8,044,412 | B2 | 10/2011 | Murphy et al. |
| 8,044,609 | B2 | 10/2011 | Liu |
| 8,153,475 | B1 | 4/2012 | Shum et al. |
| 8,203,161 | B2 | 6/2012 | Simonian et al. |
| 8,207,554 | B2 | 6/2012 | Shum |
| 8,269,245 | B1 | 9/2012 | Shum |
| 8,324,840 | B2 | 12/2012 | Shteynberg et al. |
| 8,362,603 | B2 | 1/2013 | Lim et al. |
| 8,404,071 | B2 | 3/2013 | Cope et al. |
| 8,410,711 | B2 | 4/2013 | Lin et al. |
| 8,410,717 | B2 | 4/2013 | Shteynberg et al. |
| 8,431,942 | B2 | 4/2013 | Butterworth |
| 8,519,437 | B2 | 8/2013 | Chakraborty |
| 8,541,951 | B1 | 9/2013 | Shum et al. |
| 8,575,642 | B1 | 11/2013 | Shum |
| 8,674,395 | B2 | 3/2014 | Shum |
| 8,704,258 | B2 | 4/2014 | Tasaki et al. |
| 2001/0022495 | A1 | 9/2001 | Salam |
| 2002/0088985 | A1 | 7/2002 | Komoto et al. |
| 2004/0070004 | A1 | 4/2004 | Eliashevich et al. |
| 2004/0190304 | A1 | 9/2004 | Sugimoto et al. |
| 2004/0195598 | A1 | 10/2004 | Tysoe et al. |
| 2004/0201598 | A1 | 10/2004 | Eliav et al. |
| 2004/0227149 | A1 | 11/2004 | Ibbetson et al. |
| 2005/0084218 | A1 | 4/2005 | Ide et al. |
| 2005/0087753 | A1 | 4/2005 | D'Evelyn et al. |
| 2005/0179376 | A1 | 8/2005 | Fung et al. |
| 2005/0199899 | A1 | 9/2005 | Lin et al. |
| 2005/0224830 | A1 | 10/2005 | Blonder et al. |
| 2006/0006404 | A1 | 1/2006 | Ibbetson et al. |
| 2006/0038542 | A1 | 2/2006 | Park et al. |
| 2006/0065900 | A1 | 3/2006 | Hsieh et al. |
| 2006/0068154 | A1 | 3/2006 | Parce et al. |
| 2006/0097385 | A1 | 5/2006 | Negley |
| 2006/0118799 | A1 | 6/2006 | D'Evelyn et al. |
| 2006/0124051 | A1 | 6/2006 | Yoshioka et al. |
| 2006/0152795 | A1 | 7/2006 | Yang |
| 2006/0177362 | A1 | 8/2006 | D'Evelyn et al. |
| 2006/0180828 | A1 | 8/2006 | Kim et al. |
| 2006/0205199 | A1 | 9/2006 | Baker et al. |
| 2006/0208262 | A1 | 9/2006 | Sakuma et al. |
| 2006/0240585 | A1 | 10/2006 | Epler et al. |
| 2006/0261364 | A1 | 11/2006 | Suehiro et al. |
| 2006/0262545 | A1 | 11/2006 | Piepgras et al. |
| 2006/0288927 | A1 | 12/2006 | Chodelka et al. |
| 2007/0018184 | A1 | 1/2007 | Beeson et al. |
| 2007/0114563 | A1 | 5/2007 | Paek et al. |
| 2007/0126023 | A1 | 6/2007 | Haskell et al. |
| 2007/0170450 | A1 | 7/2007 | Murphy |
| 2007/0181895 | A1 | 8/2007 | Nagai |
| 2007/0202624 | A1 | 8/2007 | Yoon et al. |
| 2007/0231963 | A1 | 10/2007 | Doan et al. |
| 2008/0054290 | A1 | 3/2008 | Shieh et al. |
| 2008/0151543 | A1 | 6/2008 | Wang |
| 2008/0158887 | A1 | 7/2008 | Zhu et al. |
| 2008/0173884 | A1 | 7/2008 | Chitnis et al. |
| 2008/0179607 | A1 | 7/2008 | DenBaars et al. |
| 2008/0192791 | A1 | 8/2008 | Furukawa et al. |
| 2008/0194054 | A1 | 8/2008 | Lin et al. |
| 2008/0206925 | A1 | 8/2008 | Chatterjee et al. |
| 2008/0210958 | A1 | 9/2008 | Senda et al. |
| 2008/0261341 | A1 | 10/2008 | Zimmerman et al. |
| 2008/0284346 | A1 | 11/2008 | Lee |
| 2009/0134421 | A1 | 5/2009 | Negley |
| 2009/0146170 | A1 | 6/2009 | Zhong et al. |
| 2009/0173958 | A1 | 7/2009 | Chakraborty et al. |
| 2009/0206354 | A1 | 8/2009 | Kitano et al. |
| 2009/0250686 | A1 | 10/2009 | Sato et al. |
| 2009/0252191 | A1 | 10/2009 | Kubota et al. |
| 2009/0273005 | A1 | 11/2009 | Lin |
| 2009/0309110 | A1 | 12/2009 | Raring et al. |
| 2009/0315965 | A1 | 12/2009 | Yamagata et al. |
| 2009/0321778 | A1 | 12/2009 | Chen et al. |
| 2010/0001300 | A1 | 1/2010 | Raring et al. |
| 2010/0006873 | A1 | 1/2010 | Raring et al. |
| 2010/0025656 | A1 | 2/2010 | Raring et al. |
| 2010/0055819 | A1 | 3/2010 | Ohba et al. |
| 2010/0060130 | A1 | 3/2010 | Li |
| 2010/0148210 | A1 | 6/2010 | Huang et al. |
| 2010/0149814 | A1 | 6/2010 | Zhai et al. |
| 2010/0155746 | A1 | 6/2010 | Ibbetson et al. |
| 2010/0164403 | A1 | 7/2010 | Liu |
| 2010/0200888 | A1 | 8/2010 | Kuhmann et al. |
| 2010/0207534 | A1 | 8/2010 | Dowling et al. |
| 2010/0240158 | A1 | 9/2010 | Ter-Hovhannissian |
| 2010/0244055 | A1 | 9/2010 | Greisen |
| 2010/0258830 | A1 | 10/2010 | Ide et al. |
| 2010/0320499 | A1 | 12/2010 | Catalano et al. |
| 2011/0032708 | A1 | 2/2011 | Johnston et al. |
| 2011/0038154 | A1 | 2/2011 | Chakravarty et al. |
| 2011/0057205 | A1 | 3/2011 | Mueller et al. |
| 2011/0068700 | A1 | 3/2011 | Fan |
| 2011/0069490 | A1 | 3/2011 | Liu |
| 2011/0101350 | A1 | 5/2011 | Greisen |
| 2011/0103064 | A1 | 5/2011 | Coe-Sullivan et al. |
| 2011/0108865 | A1 | 5/2011 | Aldaz et al. |
| 2011/0140150 | A1 | 6/2011 | Shum |
| 2011/0182056 | A1 | 7/2011 | Trottier et al. |
| 2011/0182065 | A1 | 7/2011 | Negley et al. |
| 2011/0186874 | A1 | 8/2011 | Shum |
| 2011/0198979 | A1 | 8/2011 | Shum et al. |
| 2011/0204763 | A1 | 8/2011 | Shum et al. |
| 2011/0204779 | A1 | 8/2011 | Shum et al. |
| 2011/0204780 | A1 | 8/2011 | Shum et al. |
| 2011/0215348 | A1 | 9/2011 | Trottier et al. |
| 2011/0279998 | A1 | 11/2011 | Su et al. |
| 2011/0291548 | A1 | 12/2011 | Nguyen The et al. |
| 2011/0317397 | A1 | 12/2011 | Trottier et al. |
| 2012/0043552 | A1 | 2/2012 | David et al. |
| 2012/0235201 | A1 | 9/2012 | Shum |
| 2012/0299492 | A1 | 11/2012 | Egawa et al. |
| 2012/0313541 | A1 | 12/2012 | Egawa et al. |
| 2013/0043799 | A1 | 2/2013 | Siu et al. |
| 2013/0313516 | A1 | 11/2013 | David et al. |
| 2013/0322089 | A1 | 12/2013 | Martis et al. |
| 2014/0042918 | A1* | 2/2014 | Lee ..... 315/185 R |
| 2014/0070710 | A1* | 3/2014 | Harris ..... 315/185 R |
| 2014/0103356 | A1 | 4/2014 | Krames et al. |
| 2014/0145235 | A1 | 5/2014 | Shum |

OTHER PUBLICATIONS

USPTO Office Action for U.S. Appl. No. 12/491,176 dated Nov. 22, 2013 (14 pages).

USPTO Office Action for U.S. Appl. No. 13/019,897 dated Dec. 2, 2013 (17 pages).

USPTO Office Action for U.S. Appl. No. 13/135,087 dated Sep. 27, 2013 (7 pages).

(56) References Cited

OTHER PUBLICATIONS

USPTO Office Action for U.S. Appl. No. 13/210,769 dated Oct. 28, 2013 (9 pages).
USPTO Office Action for U.S. Appl. No. 13/357,315 dated Oct. 15, 2013 (12 pages).
USPTO Notice of Allowance for U.S. Appl. No. 13/482,956 dated Oct. 28, 2013 (9 pages).
Benke et al., 'Uncertainty in Health Risks from Artificial Lighting due to Disruption of Circadian Rythm and Melatonin Secretion: A Review', Human and Ecological Risk Assessment: An International Journal, vol. 19, No. 4, 2013, pp. 916-929.
Csuti et al., 'Color-matching experiments with RGB-LEDs', Color Research and Application, vol. 33, No. 2, 2008, pp. 1-9.
Davis et al., 'Color quality scale', Optical Engineering, vol. 49, No. 3, Mar. 2010, pp. 033602-1-036602-16.
Hanifin et al., 'Photoreception for Circadian, Neuroendocrine, and Neurobehavioral Regulation', Journal of Physiological Anthropology, vol. 26, 2007, pp. 87-94.
Houser et al., 'Review of measures for light-source color rendition and considerations for a two-measure system for characterizing color rendition', Optics Express, vol. 21, No. 8, Apr. 19, 2013, pp. 10393-10411.
Paper and Board Determination of CIE Whiteness, D65/10 (outdoor daylight), ISO International Standard 11475:2004E (2004), 18 pgs.
Rea et al., 'White Lighting', COLOR Research and Application, vol. 38, No. 2, Sep. 3, 2011, pp. 82-92.
Whitehead et al., 'A Monte Carlo method for assessing color rendering quality with possible application to color rendering standards', Color Research and Application, vol. 37, No. 1, Feb. 2012, pp. 13-22.
USPTO Office Action for U.S. Appl. No. 13/019,897 dated Jan. 16, 2013, 7 pages.
USPTO Office Action for U.S. Appl. No. 13/210,769 dated Apr. 4, 2013, 14 pages.
USPTO Office Action for U.S. Appl. No. 13/482,956 dated Jul. 22, 2013, 17 pages.
USPTO Office Action for U.S. Appl. No. 13/600,988 dated Jul. 18, 2013, 13 pages.
USPTO Notice of Allowance for U.S. Appl. No. 13/600,988 dated Sep. 16, 2013, 9 pages.
Iso et al., 'High Brightness Blue InGaN/GaN Light Emitting Diode on Nonpolar m-Plane Bulk GaN Substrate', Japanese Journal of Applied Physics, vol. 46, No. 40, 2007, pp. L960-L962.
International Search Report of PCT Application No. PCT/US2011/048499, dated Feb. 14, 2012, 2 pages total.
Sato et al., 'Optical Properties of Yellow Light-Emitting Diodes Grown on Semipolar (1122) Bulk GaN Substrate', Applied Physics Letters, vol. 92, No. 22, 2008, pp. 221110-1-221110-3.
USPTO Office Action for U.S. Appl. No. 12/481,543 dated Jun. 27, 2011 (10 pages).
USPTO Office Action for U.S. Appl. No. 12/491,176 dated Mar. 1, 2012 (10 pages).
USPTO Office Action for U.S. Appl. No. 12/491,176 dated Jul. 19, 2012 (13 pages).
USPTO Office Action for U.S. Appl. No. 12/879,784 dated Jan. 25, 2012 (7 pages).
USPTO Notice of Allowance for U.S. Appl. No. 12/879,784 dated Apr. 3, 2012 (7 pages).
USPTO Office Action for U.S. Appl. No. 12/880,889 dated Feb. 27, 2012 (12 pages).
USPTO Office Action for U.S. Appl. No. 12/880,889 dated Sep. 19, 2012 (12 pages).
USPTO Office Action for U.S. Appl. No. 12/914,789 dated Oct. 12, 2011 (8 pages).
USPTO Office Action for U.S. Appl. No. 12/914,789 dated Feb. 24, 2012 (9 pages).
USPTO Notice of Allowance for U.S. Appl. No. 12/914,789 dated May 17, 2012 (5 pages).
USPTO Office Action for U.S. Appl. No. 13/019,897 dated Mar. 30, 2012 (15 pages).
USPTO Office Action for U.S. Appl. No. 13/019,897 dated Jun. 12, 2014 (8 pages).
USPTO Office Action for U.S. Appl. No. 13/025,833 dated Jul. 12, 2012 (16 pages).
USPTO Office Action for U.S. Appl. No. 13/211,145 dated Oct. 17, 2012 (21 pages).
USPTO Notice of Allowance for U.S. Appl. No. 13/298,905 dated Jun. 11, 2013 (9 pages).
USPTO Office Action for U.S. Appl. No. 13/482,956 dated Aug. 17, 2012 (10 pages).
USPTO Office Action for U.S. Appl. No. 13/482,956 dated Feb. 14, 2013 (16 pages).
USPTO Office Action for U.S. Appl. No. 13/904,237 dated May 22, 2014 (13 pages).
USPTO Office Action for U.S. Appl. No. 14/171,885 dated Mar. 28, 2014 (8 pages).
USPTO Office Action for U.S. Appl. No. 13/781,633 dated Mar. 6, 2014, 12 pages.

* cited by examiner

200

800

1100

1200

1400

1600

1700

1800

| Input | | | | Stage 1 | | | | | Stage 2 | | | | | Stage 3 | | | | |
|---|---|---|---|---|---|---|---|---|---|---|---|---|---|---|---|---|---|---|
| $V_{RMS}$ | $V_{Peak}$ | Freq | n | $I_{Avg}$ | $I_{On}$ | $V_{Avg}$ | $V_{On}$ | n | $I_{Avg}$ | $I_{On}$ | $V_{Avg}$ | $V_{On}$ | n | $I_{Avg}$ | $I_{On}$ | $V_{Avg}$ | $V_{On}$ |
| 120 | 170 | 60 | 14 | 368 | 50 | 57 | 46 | 25 | 208 | 368 | 94 | 101 | 38 | 143 | 206 | 130 | 135 |

| | |
|---|---|
| n | 1 |
| $V_{T_RMS}$ | 119.7 V |
| $I_{T_RMS}$ | 207.7 mA |
| $I_{Out_Ave}$ | 172 mA |
| $P_{Out_Ave}$ | 19.6 W |
| $P_{RMS}$ | 24.9 W |
| $P_{LIO_Ave}$ | 15.4 W |
| $P_{FET_Ave}$ | 4.1 W |
| PF | 0.79 |
| EFF | 78.8 % |

1900

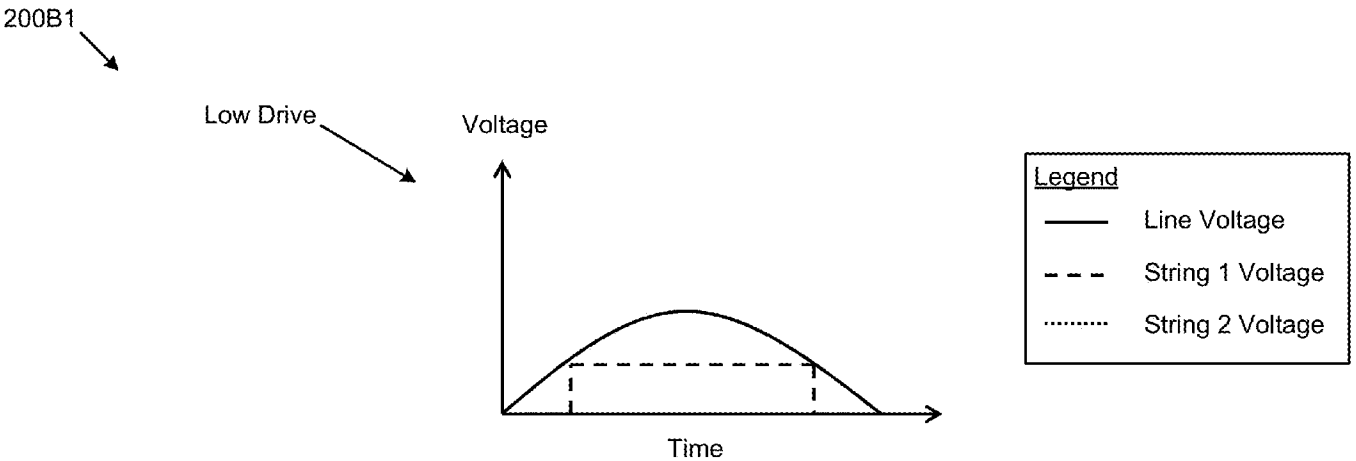
FIG. 20B1
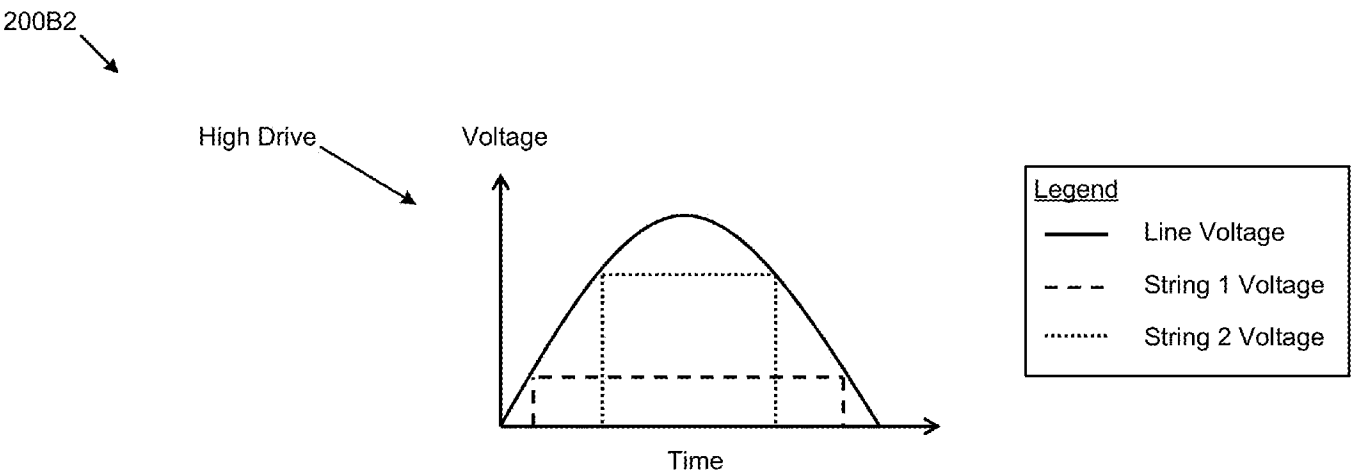
FIG. 20B2

2100

3800

HIGH TEMPERATURE LED SYSTEM USING AN AC POWER SOURCE

CROSS-REFERENCES TO RELATED APPLICATIONS

This application is a continuation-in-part of U.S. patent application Ser. No. 13/298,905, entitled "High Temperature LED System Using an AC Power Source", filed on Nov. 17, 2011, which claims priority to U.S. Provisional Patent Application No. 61/414,821, filed on Nov. 17, 2010, and U.S. Provisional Patent Application No. 61/435,915, filed on Jan. 25, 2011, each of which is commonly assigned and hereby incorporated by reference.

BACKGROUND OF THE INVENTION

The present disclosure relates generally to lighting techniques. More specifically, embodiments of the disclosure are directed to circuits to drive LEDs with AC power. In one embodiment, the present disclosure provides a feedback system for automatic current compensation that stabilizes the amount of energy delivered to multiple arrays of LED devices. LED systems powered from AC power, especially those using multiple arrays of LED devices, can generate heat, and cause high operating temperatures, and thus can seize advantage from designs that include high-emissivity surfaces for heat transfer. In various embodiments, an LED lamp includes a high-emissivity surface area that emits heat through, among other ways, blackbody radiation. In various embodiments, an LED lamp includes a heat sink that is attached to the LED package, and the heat sink is characterized by a thermal emissivity of at least 0.6. The need for improved lighting techniques dates back to the 1800s.

In the late 1800's, Thomas Edison invented the light bulb. The conventional light bulb, commonly called the "Edison bulb," has been used for over one hundred years. The conventional light bulb uses a tungsten filament enclosed in a glass bulb sealed in a base, which is screwed into a socket. The socket is coupled to an AC power source or DC power source. The conventional light bulb can be commonly found in houses, buildings, outdoor lighting, and other areas requiring light. Unfortunately, more than 90% of the energy used by the conventional light bulb is dissipated as thermal energy. Additionally, the conventional light bulb eventually fails due to evaporation of the tungsten filament.

Fluorescent lighting uses an optically clear tube structure filled with a noble gas and typically also contains mercury. A pair of electrodes is coupled between the gas and an alternating power source through a ballast. Once the mercury has been excited, it discharges to emit UV light. Typically, the optically clear tube is coated with phosphors, which are excited by the UV light to provide white light. Many building structures use fluorescent lighting and, more recently, fluorescent lighting has been fitted onto a base structure, which couples into a standard socket.

Solid-state lighting techniques have also been used. Solid state lighting relies upon semiconductor materials to produce light emitting diodes, commonly called LEDs. At first, red LEDs were demonstrated and introduced into commerce. Modern red LEDs use Aluminum Indium Gallium Phosphide or AlInGaP semiconductor materials. Most recently, Shuji Nakamura pioneered the use of InGaN materials to produce LEDs emitting light in the blue color range. The blue colored LEDs led to innovations such as solid state white lighting and the blue laser diode, which in turn enabled the Blu-Ray™ (trademark of the Blu-Ray Disc Association) DVD player, and other developments. Blue, violet, or ultraviolet-emitting devices based on InGaN are used in conjunction with phosphors to provide white LEDs. Other colored LEDs have also been proposed.

One of the challenges for LED systems, especially those using arrays of LED devices, has been managing the heat generated by LED packages during operation. Various techniques such as using fans (with a down-conversion transformer) have been proposed for solving these overheating problems. Unfortunately, many techniques have been inadequate in various ways. Therefore, improved systems and methods for LED thermal management are desirable.

BRIEF SUMMARY OF THE INVENTION

According to the present disclosure, techniques generally related to lighting are provided. More specifically, embodiments of the disclosure are directed to LED lamps that use circuits to drive LEDs with AC power. Exemplary embodiments are directed to LED lighting systems that include high emissivity surfaces for transfer of heat generated by the LED devices and by the circuits used to drive the LEDs (e.g., with AC power). An LED lamp includes a high-emissivity surface area that emits heat through, among other ways, blackbody radiation. In various embodiments, an LED lamp includes a heat sink that is attached to the LED package, and the heat sink is characterized by a thermal emissivity of at least 0.6.

According to an embodiment, the present disclosure provides an LED package which includes a submount having a front surface and a back surface. The front surface includes an inner region and an outer region, the inner region being characterized by a reflectivity of at least 80%. The apparatus also includes LED die disposed on the inner region of the submount. The LED die typically operate at 100 degrees Celsius or higher. The apparatus further includes a heat sink directly coupled to the back surface of the submount, the heat sink being characterized by a thermal emissivity of at least 0.5.

According to another embodiment, an LED lighting system is powered by an AC power source. The power is conditioned using a rectifier module configured to provide a rectified output to a first group of LED devices and a second group of LED devices. A current monitor module is electrically coupled to the first group and second group of LED devices, and is configured to determine a first current level using a drawn current level signal associated with the first group of LED devices and a second current level using a reference current level signal associated with the second group of LED devices. The current monitor module is electrically coupled to a temperature sensing module that is configured to generate at least one compensation factor based at least in part on a temperature. The compensation factor is used to control (directly or indirectly) current through the LED devices.

BRIEF DESCRIPTION OF THE DRAWINGS

FIG. 20B1 is a simplified diagram illustrating the performance of a circuit according to one embodiment.

FIG. 20B2 is a simplified diagram illustrating the performance of a circuit according to another embodiment.

DETAILED DESCRIPTION OF THE INVENTION

It is often desirable to arrange LED devices in arrays, pot the arrays into packages, and power the LED devices with an AC power source. For various applications, it is often desirable to be able to automatically compensate AC current when operating optical apparatus having multiple LEDs. Various techniques have been implemented for AC current compensation. For example, one implementation involves controlling strings of LED devices with switches. More specifically, a string of LEDs have a number of intermediate taps or electrical connections dividing the series string into sub-strings.

Overview

Figure 1:
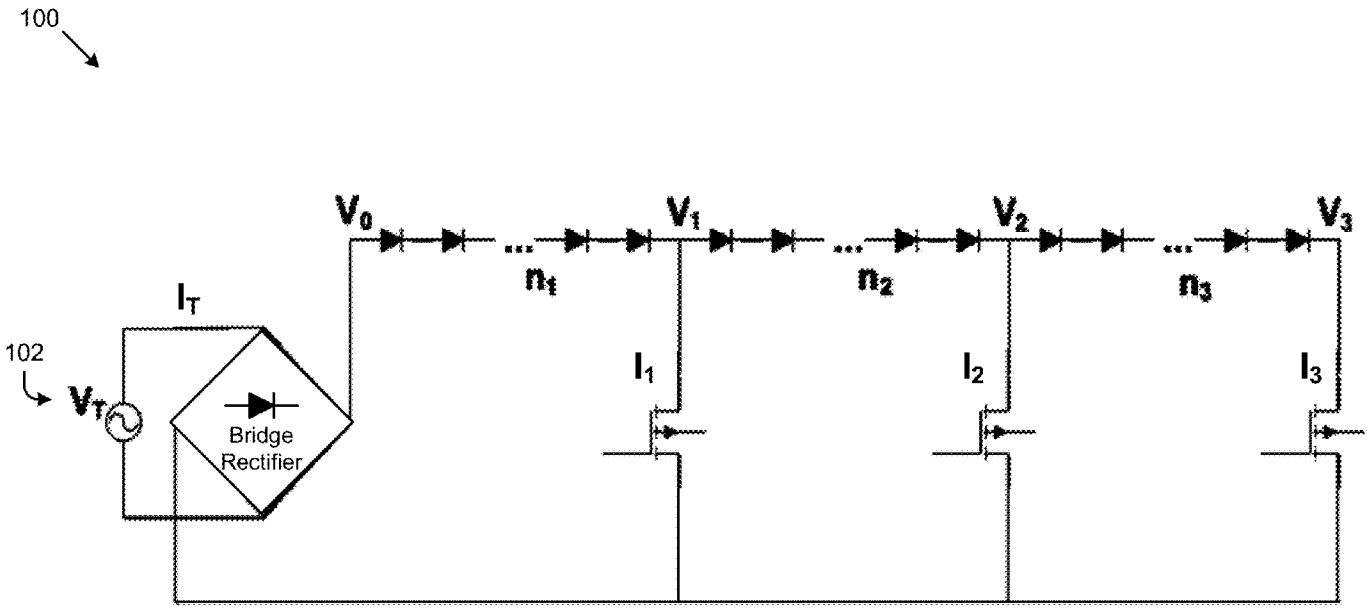
FIG. 1 is a simplified circuit schematic illustrating a LED apparatus having multiple LEDs and switches, according to some embodiments.

FIG. 1 is a simplified circuit schematic 100 illustrating a LED apparatus having multiple LEDs and switches. The LED apparatus as shown in FIG. 1 is often inefficient.

Figure 2:
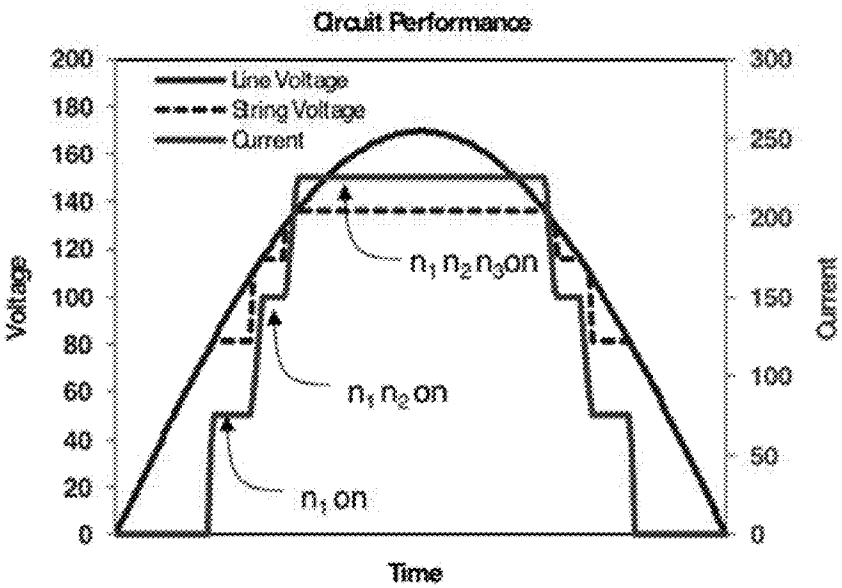
FIG. 2 is a simplified diagram illustrating the performance of the circuit illustrated in FIG. 1, according to some embodiments.

FIG. 2 is a simplified diagram 200 illustrating the performance of the circuit illustrated in FIG. 1. As shown in FIG. 1, there are 3 sub-strings of LED devices respective consisting of $n_1$, $n_2$, and $n_3$ LEDs per sub-string. As the AC line voltage (e.g., from an AC power source) increases from zero volts, first the $n_1$ string is turned on by the first transistor that regulates a current $I_1$. As the voltage further increases, the first transistor turns off while the second transistor (which regulates a current $I_2$) turns on powers both string $n_1$ and $n_2$. As the line voltage increases further, the second transistor turns off and the third transistor turns on, thus powering the entire string $n_1$, $n_2$, $n_3$ to a current $I_3$.

The power control scheme illustrated in FIG. 1 can be improved using the techniques disclosed herein. One aspect of implementations according to FIG. 1 is that the average current fluctuates with variations in line voltage or variation in the forward voltage of the LEDs. This type of current fluctuation is often undesirable. Therefore it is to be appreciated that embodiments of the present disclosure proposes a feedback control mechanism where setting of the nominal current $I_1$, $I_2$, and $I_3$ are based on monitoring of the average current.

Current Management

Figure 3:
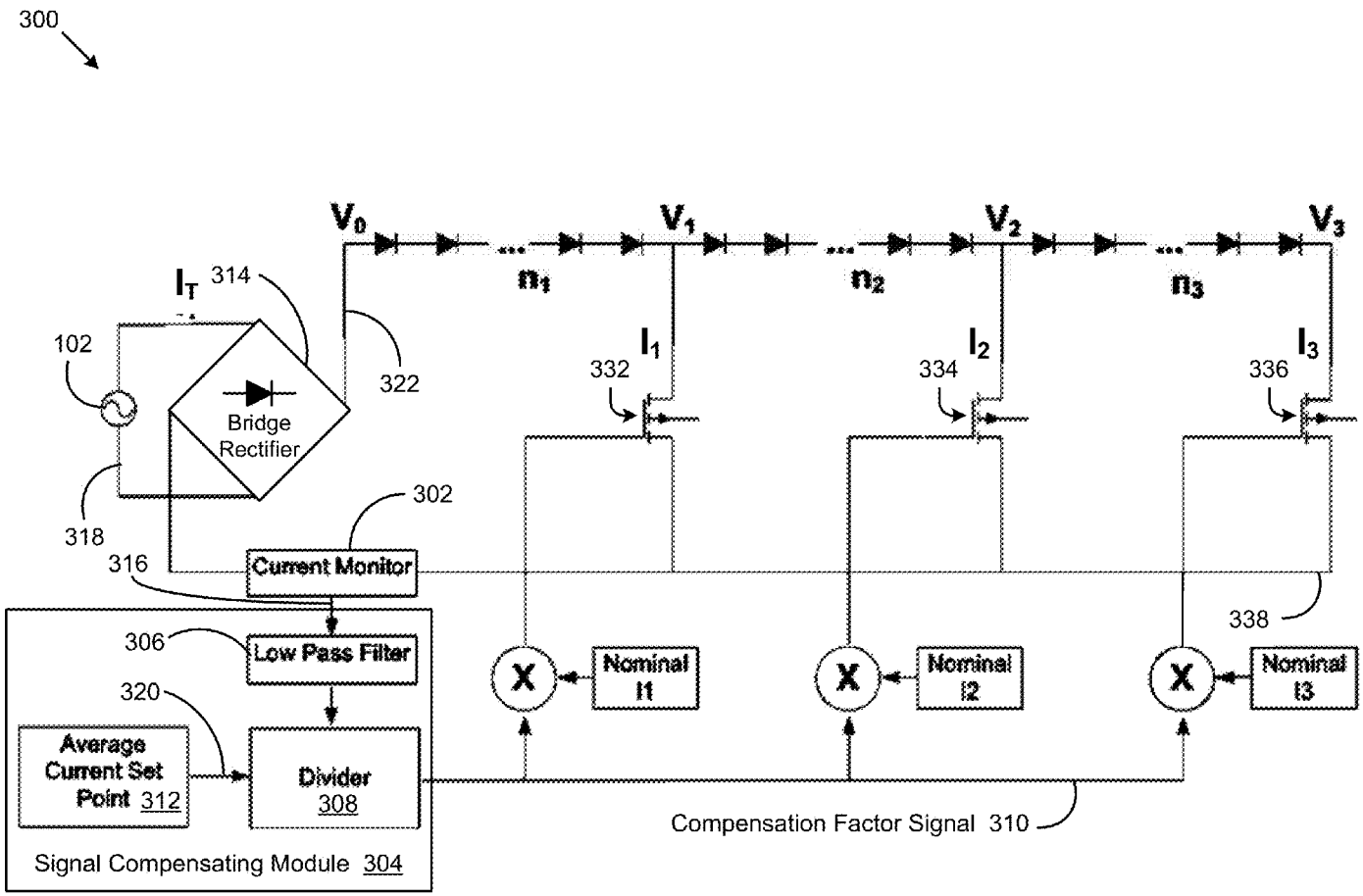
FIG. 3 is a simplified diagram illustrating an LED array system, according to some embodiments.

FIG. 3 is a simplified diagram 300 illustrating an LED array system according to an embodiment of the present disclosure. This diagram is merely an example, which should not unduly limit the scope of the claims herein. One of ordinary skill in the art would recognize other variations, modifications, and alternatives. As shown, an alternating voltage from an AC power source is rectified by a rectifier module (e.g., bridge rectifier 314) to produce a rectified output 322 with respect to a reference voltage 318. Also as shown, a current monitor module 302 is provided and drawn-current-level signal 316 between the current monitor module and the signal compensating module 304, which drawn current level signal 316 goes through a low pass filter 306. Among other things, one of the purposes of the low-pass filter is to average out the 60 Hz or 120 Hz natural variation of the system to produce a signal that substantially represents the average DC current. In this embodiment, a divider module 308 is provided to generate a compensation factor signal 310 based on the difference between the actual average current and the desired average set point signal (e.g., reference current level signal 320) as provided by the average current set point module 312. The purpose of the compensation factor signal 310 is to adjust the nominal current in each stage until the desired average set point is reached.

Accordingly, to adjust the nominal current in each stage until the desired average set point is reached, a first switch 332 is positioned between the first stage and the second stage, and a second switch 334 is positioned between the second stage and a third stage, and a third switch 336 is positioned between voltage V3 (as shown) and reference signal 338.

As shown in FIG. 3, the divider module 308 is used to generate an error signal (e.g., a compensation factor signal 310). Depending on the application, the compensation factor signal 310 can be generated by other means as well. For example, the function of the divider module can be replaced by a differential operational amplifier module that generates a compensating signal based on the difference between the signals. In various embodiments, the signal compensating function of the divider module can be implemented either in analog or digital circuits.

It is to be appreciated that the embodiments of the present disclosure can be implemented in various ways. In various embodiments, a feedback scheme based on operating current is provided. Among other things, the proposed feedback mechanism can be implemented to fully compensate for line voltage (or forward voltage).

Figure 4:
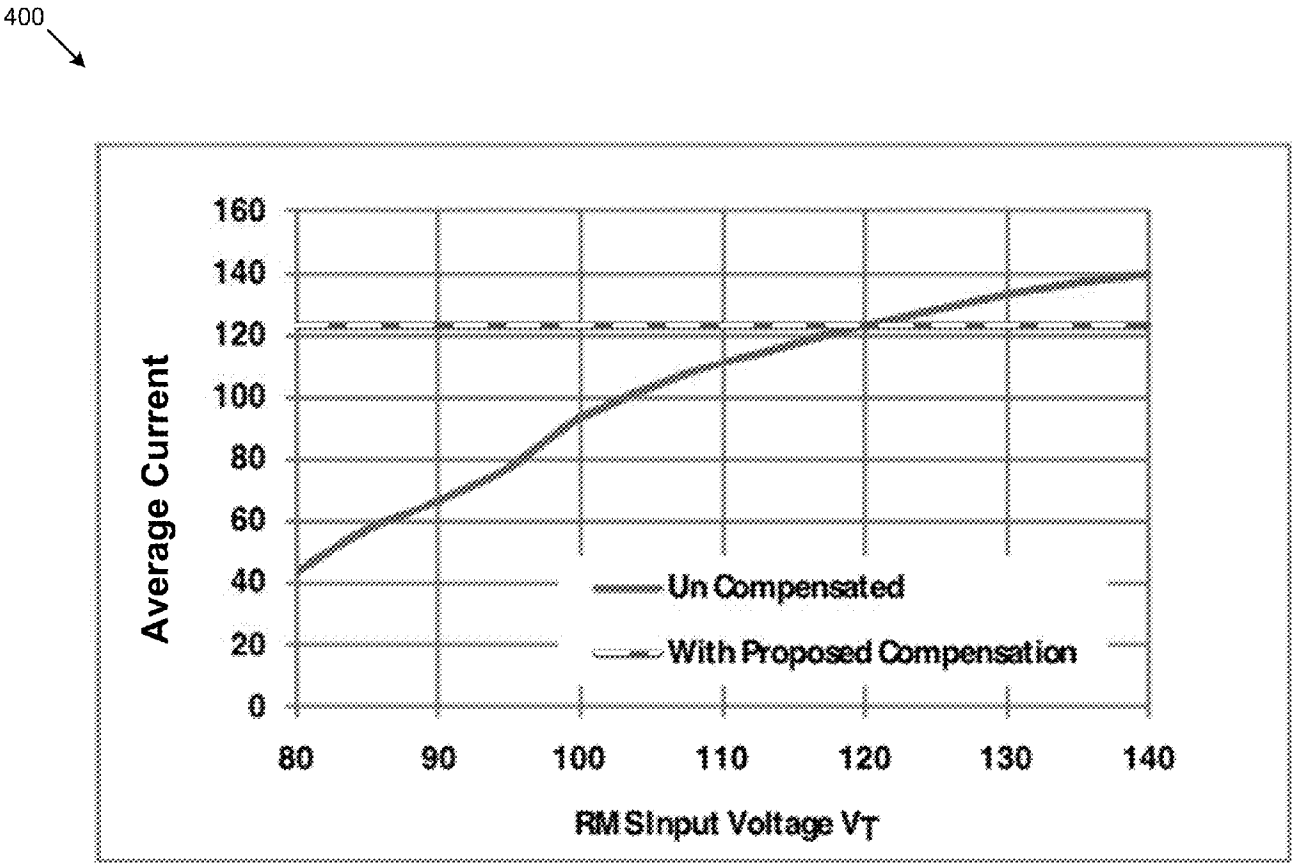
FIG. 4 is a graph illustrating average current from an LED system, according to some embodiments.

FIG. 4 is a graph 400 illustrating average current from an LED system according to an embodiment of the present disclosure. In another embodiment, the desired average current set point is programmable. It is to be appreciated that the feedback control system illustrated in FIG. 3 has a wide range of applications. In addition to reducing current fluctuation and stabilizing system performance, the system (and its variations) can be used to implement a one-time setting in the stabilizing factor to ensure that all the LED devices have the same light output. Additionally, the feedback system described above is useful in making adjustments for dimming the LED devices.

It is to be appreciated that embodiments of the present disclosure also provide a means for efficiently arranging LED devices. Now referring back to FIG. 1: In a possible configuration for utilizing an AC power supply for driving LED devices, a string of LED devices comprises a number of intermediate taps or electrical connections dividing the overall series into sub-strings. For example as shown in FIG. 1, there are 3 substrings respectively having $n_1$, $n_2$, and $n_3$ number of LED devices per sub-string. As the AC line voltage increases from zero volts, first the $n_1$ string is turned on via the first FET1 regulated to a current $I_1$. As the voltage further increases, the first FET (FET1) turns off while the second FET (FET2) turns on power for both string $n_1$ and $n_2$ to a current $I_2$. As the line voltage increases further, FET2 turns off and the third FET (FET3) turns on thus powering the entire string $n_1$, $n_2$, $n_3$ to a current $I_3$. As explained above, the configuration shown in FIG. 1 is inadequate.

Figure 5:
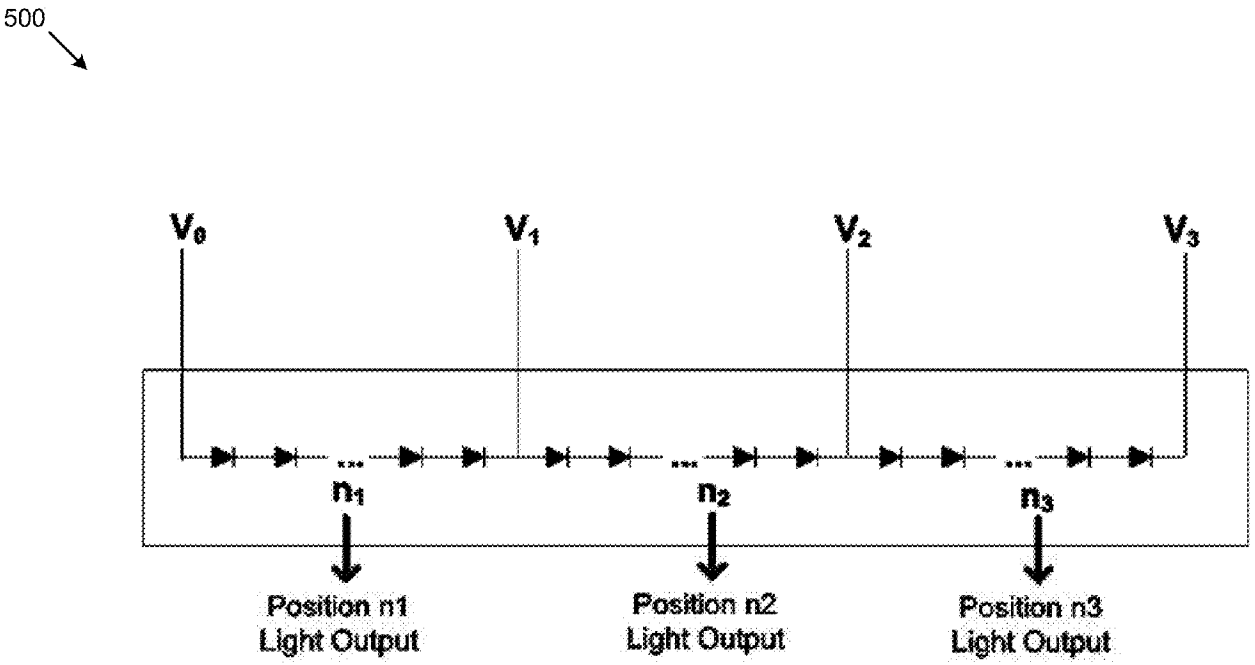
FIG. 5 is a simplified diagram illustrating uneven light output for linear light, according to some embodiments.

FIG. 5 is a simplified diagram 500 illustrating spatially uneven light output for a linear light source. As shown, the LED string $n_1$ is turned on for the longest period. Therefore, the $n_1$ is the brightest while the string $n_3$ is turned on the least amount of time thus the dimmest. As a result, for a simple implementation of a linear LED lamp as illustrated in FIG. 5, there is a problem with non-uniform light output where the position (or physical location) at the end near $n_1$ is brighter than the other end near $n_3$. It is to be appreciated that embodiments of the present disclosure provide more even light output when LED devices are arranged as a linear array.

Figure 6:
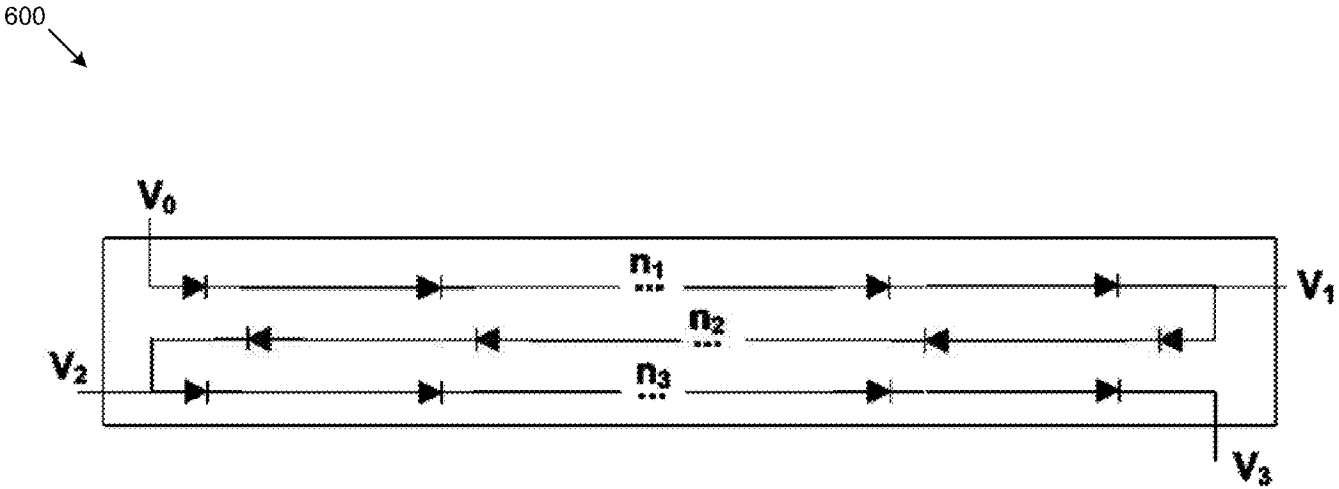
FIG. 6 is a simplified diagram illustrating an array of LED devices, according to some embodiments.

FIG. 6 is a simplified diagram illustrating an array of LED devices 600 according to an embodiment of the present disclosure. This diagram is merely an example, which should not unduly limit the scope of the claims herein. One of ordinary skill in the art would recognize other variations, modifications, and alternatives. As shown in FIG. 6, the LEDs in each string are interspersed so they substantially overlap the same lighting area. Thus in a single area or region of the linear LED lamp, light output is relatively even.

FIG. 6 depicts improvement for light output with interspersed strings. Embodiments of the present disclosure also provide even output for directional lighting. In directional lighting, a single lens is typically used to direct light out from multiple LED devices onto a location. In such cases, uneven or unbalanced light output is generated. For example, an array of LED devices 600, possibly embodied in an LED package, are positioned within an aperture on which a lens a placed. The lens translates the position of the LEDs into pattern angles. Thus if only a simple positioning of LEDs was used, there would be an uneven lighting gradient across the output of the lens. In various embodiments of the present disclosure, LED devices of different colors are arranged according to a predetermined pattern, which allows the combined light output from colored LED devices to be in a desired color.

Figure 7:
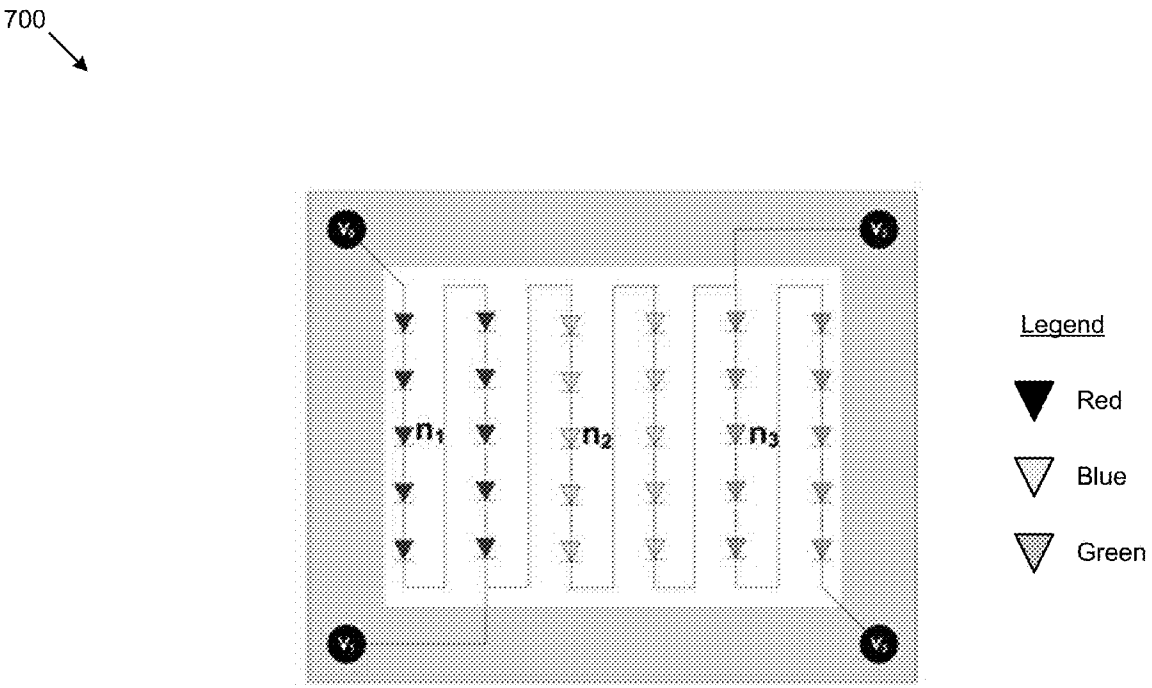
FIG. 7 is a simplified diagram illustrating an LED array with an aperture, according to some embodiments.

FIG. 7 is a simplified diagram 700 illustrating an LED array with an aperture. As shown in FIG. 7, three strings ($n_1$, $n_2$, and $n_3$) of LED devices are provided, and each string of LEDs is associated with a specific color. For example, the string $n_1$ comprises red color LEDs, the string $n_2$ comprises blue color LEDs, and the string $n_3$ comprises green color LEDs. In operation, red light is emitted from the left side of the LED array from the string $n_1$, blue light is emitted from the middle of the LED array from the string $n_2$, and the green light is emitted from the right side of the LED array from the string $n_3$.

Figure 8:
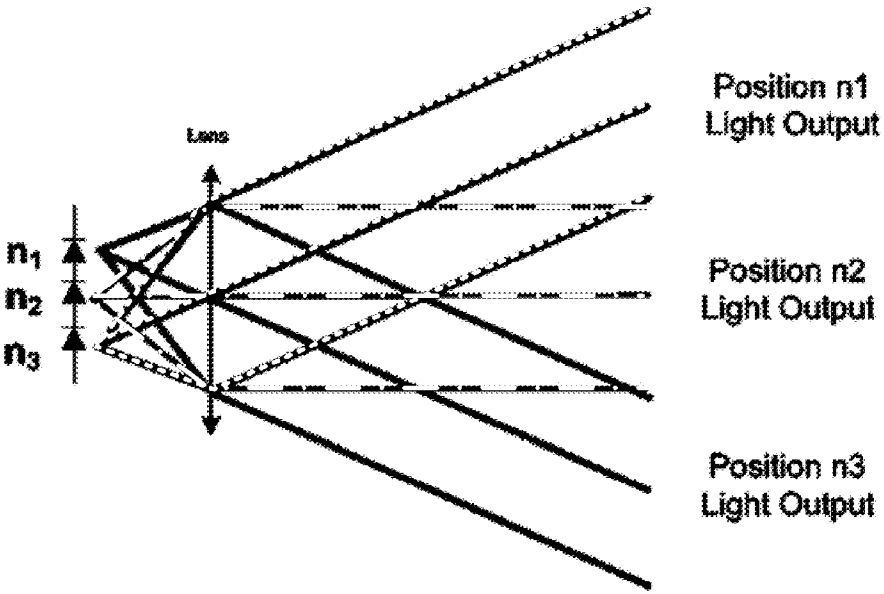
FIG. 8 is a light output diagram, according to some embodiments.

FIG. 8 is a light output diagram 800 depicting one of many embodiments where the LED array is characterized by a small size (e.g., less than 100 $cm^2$ in surface area), and the light with an uneven color distribution LED array itself does not cause a problem. However, when used in directional lighting, the light output from the LED array is projected by one or more optical members (e.g., lenses) onto a larger area. FIG. 8 is a simplified diagram illustrating an LED array having a lens. As shown in FIG. 8, light from different strings of LED devices is projected into different locations. Since each string is associated with a different color, a different color is projected onto each location.

In various embodiments, the present disclosure provides configurations for arranging LED arrays. More specifically, LED devices of different colors are evenly interspersed.

Figure 9:
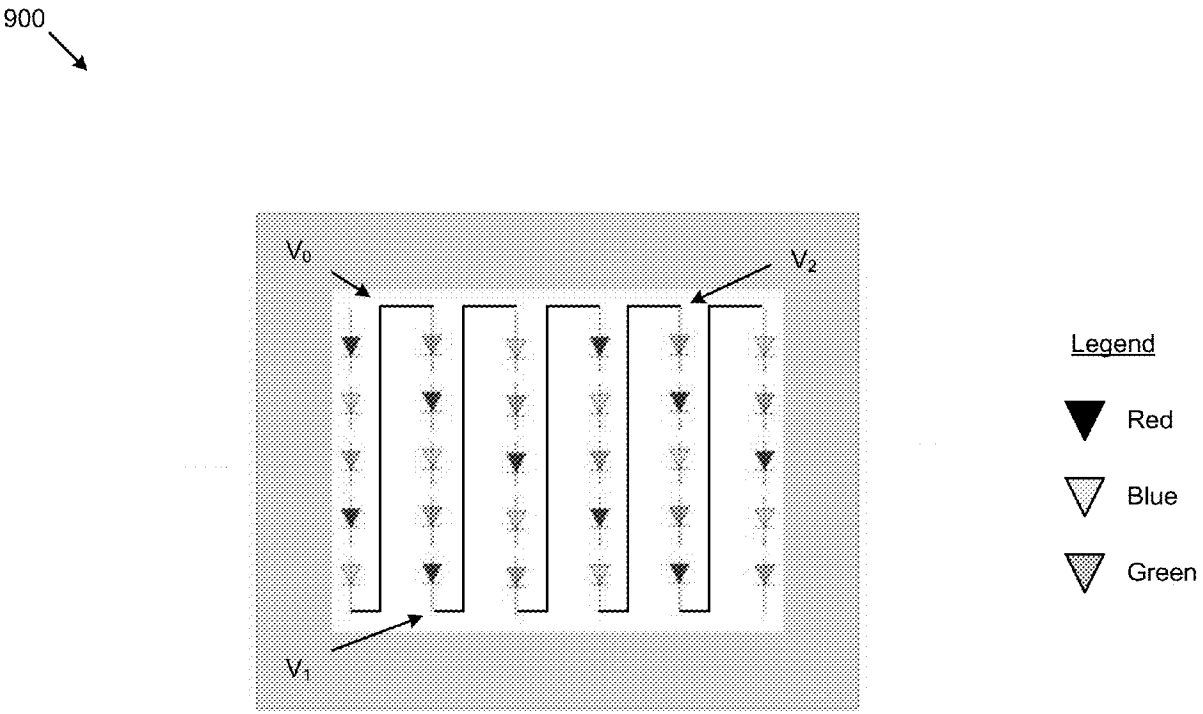
FIG. 9 is a simplified diagram where LED devices of different colors are evenly interspersed, according to some embodiments.

FIG. 9 is a simplified diagram 900 where LED devices of different colors are evenly interspersed. This diagram is merely an example, which should not unduly limit the scope of the claims. One of ordinary skill in the art would recognize many variations, alternatives, and modifications. For example, each string of LED devices (as a part of the LED array) has a mix of LED devices of different color. In an exemplary arrangement, LED devices are arranged in a pattern of red, blue, and green. It is to be appreciated that, depending on the desired output color, many other patterns are possible.

Figure 10:
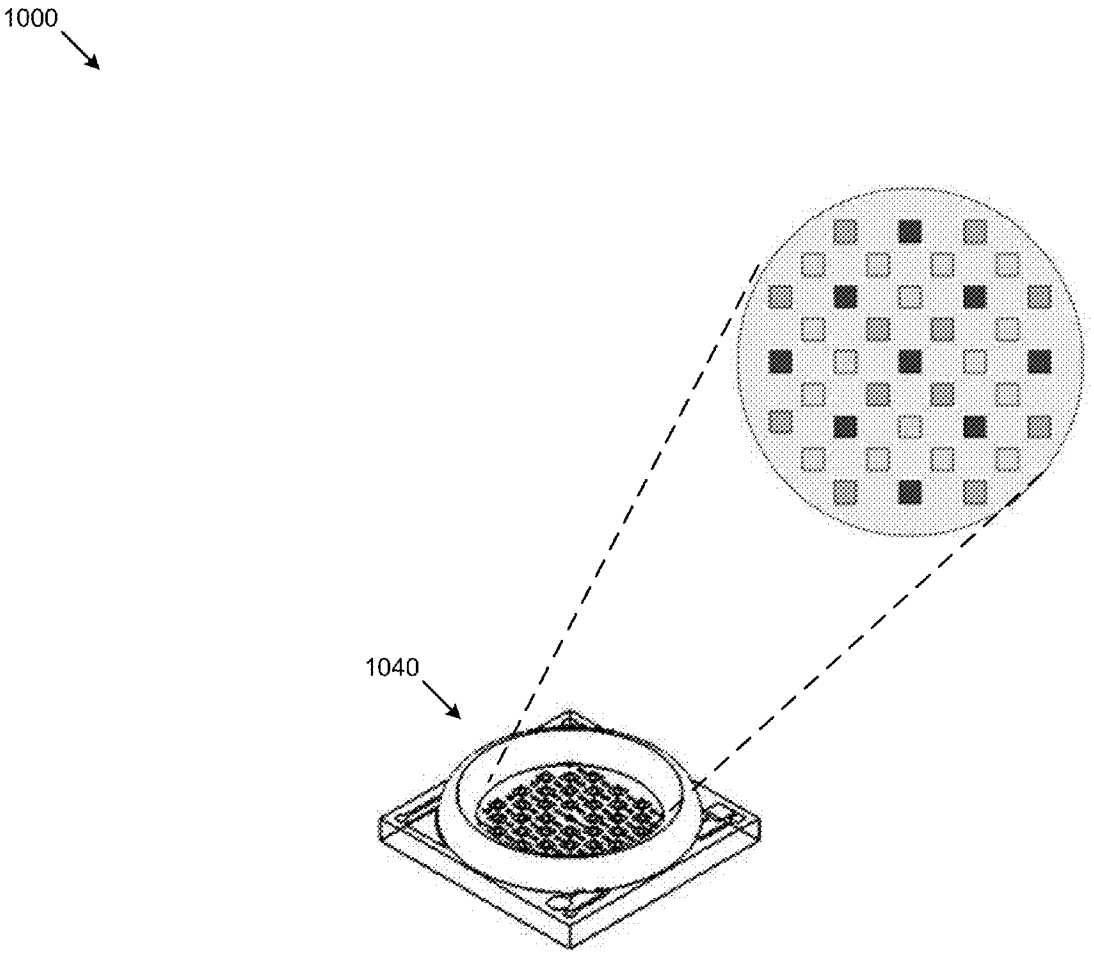
FIG. 10 is a top view of an LED package 1040 where LED devices of different colors are evenly interspersed, according to some embodiments.

FIG. 10 is a top view 1000 of an LED package 1040 where LED devices of different colors are evenly interspersed. This diagram is merely an example, which should not unduly limit the scope of the claims. One of ordinary skill in the art would recognize many variations, alternatives, and modifications. For example, the pattern of color LED devices is predetermined based on a desired color output. The LED devices shown in the arrangement of FIG. 10 can be electrically coupled to one another in various ways, such as the arrangement shown in FIG. 9. It is to be appreciated that other ways of arranging LED devices are possible as well.

Figure 11:
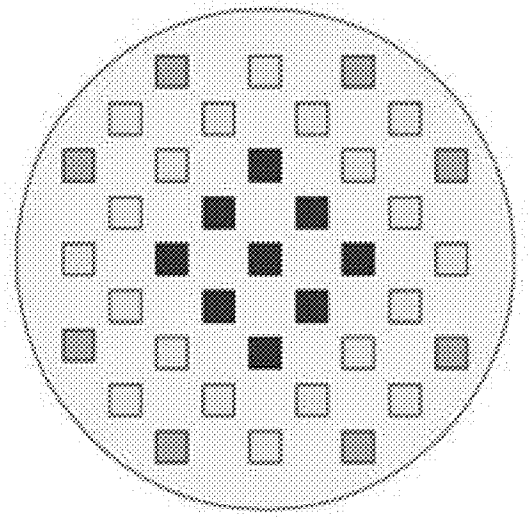
FIG. 11 is a simplified diagram illustrating a concentric pattern for arranging colored LED devices, according to some embodiments.

FIG. 11 is a simplified diagram 1100 illustrating a concentric pattern for arranging colored LED devices. This diagram is merely an example, which should not unduly limit the scope of the claims. One of ordinary skill in the art would recognize many variations, alternatives, and modifications.

In another implementation, the stings are arranged in substantially concentric rings around the center. Here there is still fall off due to differential turn-on times but the fall off should follow the natural concentric fall off of a directional lamp with respect to the angle. In one embodiment, the $n_1$ string, which is on the longest path, is located at the center, with string $n_2$ located in the next ring, while string $n_3$, the string that is on the shortest path, is located in the outermost area. For example, the arrangement of strings of LED devices is based on the optical properties of the optical member that projects and/or spreads the light emitted by the LED devices.

Figure 12:
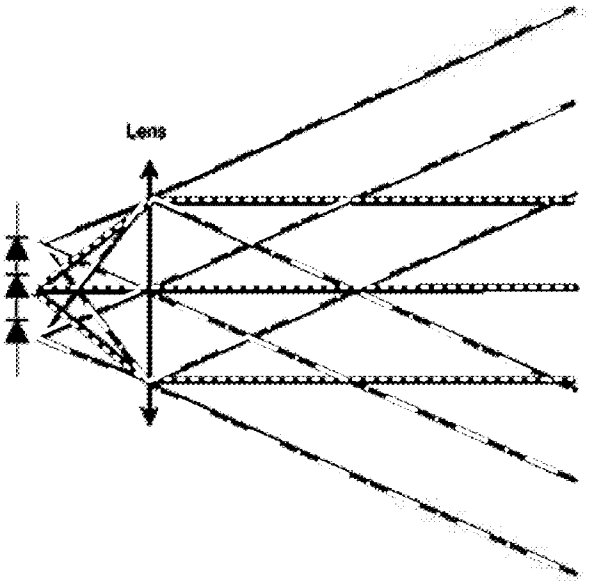
FIG. 12 is a simplified diagram illustrating a light path for LED devices arranged in concentric rings, according to some embodiments.

FIG. 12 is a simplified diagram 1200 illustrating a light path for LED devices arranged in concentric rings. This diagram is merely an example, which should not unduly limit the scope of the claims. One of ordinary skill in the art would recognize many variations, alternatives, and modifications.

It is to be understood that the arrangement and implementation of driving circuits is an important aspect for LED-based lamps. Now referring back to FIGS. 1 and 2, LED devices dividing into segments of devices are driven by a bridge circuit in a possible LED-based lamp. More specifically, a string of LEDs have a number of intermediate taps or electrical connections dividing the overall series into sub-strings. As illustrated in FIG. 1, there are three substrings comprised of $n_1$, $n_2$, and $n_3$'s number of LEDs per sub-string. As the AC line voltage increases from zero volts, first the $n_1$ string is turned on via the first FET1 regulated to a current $I_1$. As the voltage further increases, the first FET (FET1) turns off while the second FET (FET2) turns on power both string $n_1$ and $n_2$ to a current $I_2$. As the line voltage increases further, FET2 turns off and the third FET (FET3) turns on thus powering the entire string $n_1$, $n_2$, $n_3$ to a current $I_3$.

The circuit design as illustrated in FIG. 1 is developed for high voltage application such as 120 VAC. In contrast, embodiments of the present disclosure can be used in conjunction with different AC power levels, including low voltage AC applications. In particular, these techniques are applicable to LED micro-arrays. It is to be appreciated that micro-arrays are tremendously flexible in arrangement of LEDs and number of LEDs to match the drive voltage and output power requirements. A few examples are given below.

Figure 13:
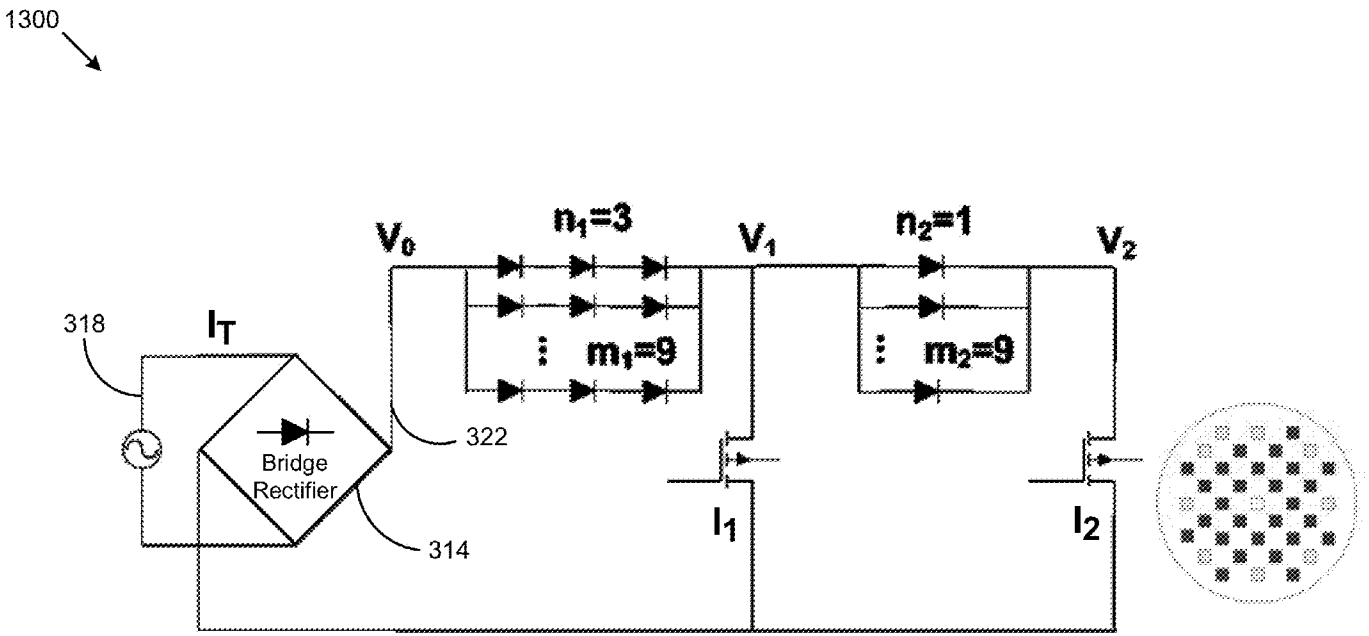
FIG. 13 is a simplified diagram illustrating an LED apparatus where LED devices are arranged in two stages, according to some embodiments.

FIG. 13 is a simplified diagram 1300 illustrating an LED apparatus where LED devices are arranged in two stages. This diagram is merely an example, which should not unduly limit the scope of the claims. One of ordinary skill in the art would recognize many variations, alternatives, and modifications. As shown, AC power is rectified by a rectifier module (e.g., bridge rectifier 314) to produce a rectified output 322 with respect to a reference voltage 318. At the first stage, 9 strings of LED devices are configured in parallel. A first switch is positioned between the first stage and the second stage, and a second switch is positioned between voltage V2 (as shown) and a reference signal. At the second stage, there are also 9 strings of LED devices. For example, each string of LED devices includes 3 LED devices, but the number can be varied depending on the specific application and the type of LED used. In an embodiment, each of the stages is associated with a specific color. For example, red colored LED devices are used in the first stage, and blue colored LED devices are used in the second stage. From a top view, various strings of LED devices are arranged in a mixed pattern so that different colors are properly mixed.

Table 1 illustrates the voltage level at various points of the LED apparatus illustrated in FIG. 13. As illustrated in Table 1, since LED devices are electrically arranged in a parallel configuration, it is possible to power many LED devices at a low input voltage. Additionally, the parallel configuration also provides redundancy such that if one or more LED device is broken and thus creates an open circuit, only a string of LED devices is dimmed. In comparison, if all of the LED devices are arranged in series, a single broken LED device can potentially dim the entire system. Table 2 summarizes various measurements of the LED apparatus illustrated in FIG. 13.

TABLE 1

| Voltage Levels | | | | | | | | | | | | | | | | |
|---|---|---|---|---|---|---|---|---|---|---|---|---|---|---|---|---|
| Input | | | Stage 1 | | | | | Stage 2 | | | | | Stage 3 | | | |
| $V_{RMS}$ | $V_{Peak}$ | Freq | n | $I_{reg}$ | $I_{On}$ | $V_{reg}$ | $V_{On}$ | n | $I_{reg}$ | $I_{On}$ | $V_{reg}$ | $V_{On}$ | n | $I_{reg}$ | $I_{On}$ | $V_{reg}$ | $V_{On}$ |
| 12 | 17 | 60 | 3 | 60 | 50 | 10 | 10 | 4 | 180 | 60 | 16 | 14 | 4 | 180 | 180 | 16 | 16 |

TABLE 2

| Measurements (M) Summary | | |
|---|---|---|
| M = | 1 | 9 |
| $V_{TRMS}$ | 12 V | |
| $I_{T\ RMS}$ | 105 mA | 948 mA |
| $I_{inst\ Ave}$ | 74 mA | 699 mA |
| $P_{inst\ Ave}$ | 1.1 W | 10.3 W |
| $P_{RMS}$ | 1.3 W | 11.3 W |
| $P_{LED\ Ave}$ | 1.1 W | 9.8 W |
| $P_{PET\ Ave}$ | 0.1 W | 0.5 W |
| PF | 0.91 | |
| EFF | 95.1% | |

Figure 14:
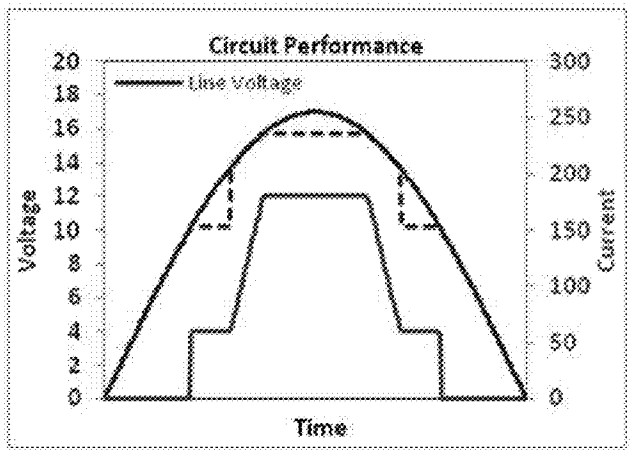
FIG. 14 is a simplified diagram illustrating the performance of the circuit illustrated in FIG. 13, according to some embodiments.

FIG. 14 is a simplified diagram 1400 illustrating the performance of the circuit illustrated in FIG. 13. This diagram is merely an example, which should not unduly limit the scope of the claims. One of ordinary skill in the art would recognize many variations, alternatives, and modifications.

Figure 15:
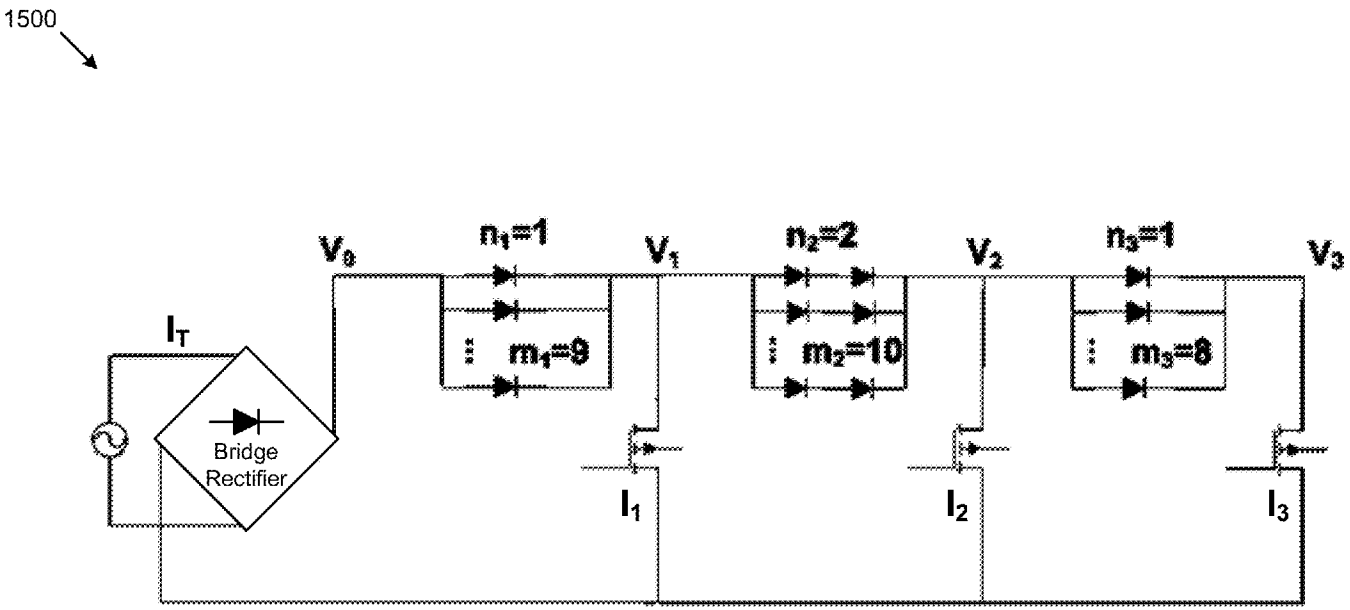
FIG. 15 is a simplified diagram illustrating an LED apparatus having LED devices arranged in three stages, according to some embodiments.

FIG. 15 is a simplified diagram 1500 illustrating an LED apparatus having LED devices arranged in three stages according to an embodiment of the present disclosure. As an example, the LED apparatus is optimized to allow dimming and reduce flickering. In various embodiments, each stage of LED devices is associated with a specific color. For example, the first stage of LED devices comprises red LEDs, the second comprises blue LEDs, and the third comprises green LEDs.

Figure 16:
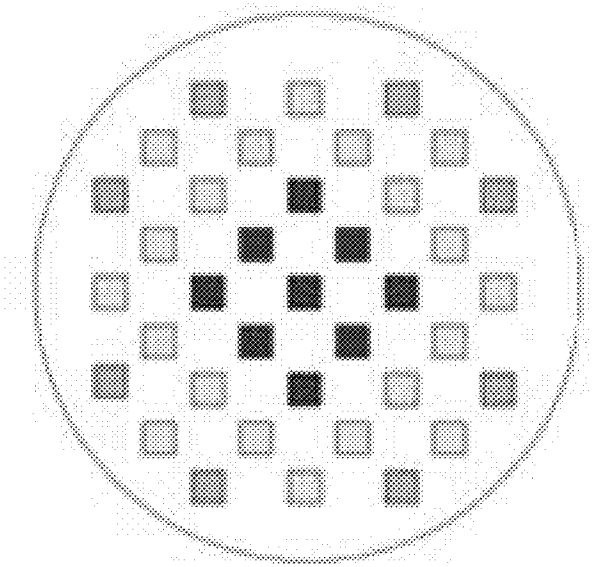
FIG. 16 is a top view of the LED apparatus having the circuit arrangement illustrated in FIG. 15, according to some embodiments.

FIG. 16 is a top view 1600 of the LED apparatus having the circuit arrangement illustrated in FIG. 15. For example, the LED devices are arranged according to a predetermined pattern.

Now referring back to FIG. 15, the circuit as shown in FIG. 15 has improved dimming and flicker characteristics due to a low number "$n_1$=1" of LED in stage 1. That is, single LEDs are arranged in parallel. This means the line voltage can be as low as the forward voltage of a single LED and the array will still turn on. Also the selection of "n=1" allows stage one to turn on earlier and potentially reduce flicker.

In various embodiments, the arrangement of parallel strings (M1, M2, M3) in each stage is not the same. More specifically, strings $m_1$, $m_0$, and $m_3$ respectively have 9, 10, and 8 LED devices in a parallel configuration. The reason for the different number is to accomplish a symmetrical layout for a circular aperture. The difference in a parallel string does not affect the average current when the FET regulators do not know the number of parallel strings. For example, a fixed current is provided regardless of the number of strings. Table 3 illustrates power measurements at various points of the LED apparatus illustrated in FIG. 15, and Table 4 illustrates power consumption and efficiency of the LED apparatus illustrated in FIG. 15.

TABLE 4-continued

| Summary | | |
|---|---|---|
| M = | 1 | 9 |
| $P_{inst\ Ave}$ | 1.2 W | 11.3 W |
| $P_{RMS}$ | 1.3 W | 11.3 W |
| $P_{LED\ Ave}$ | 1.1 W | 10.0 W |
| $P_{PET\ Ave}$ | 0.1 W | 1.0 W |
| PF | 0.98 | |
| EFF | 90.7% | |

Figure 17:
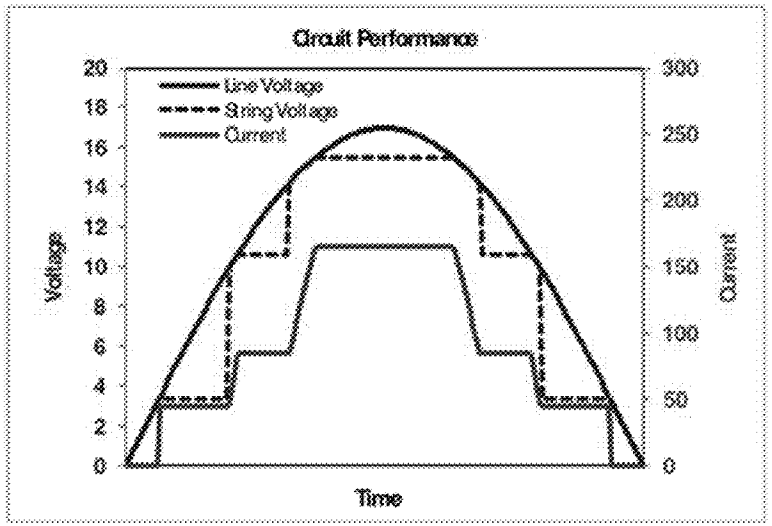
FIG. 17 is a simplified diagram illustrating the performance of the circuit illustrated in FIG. 15, according to some embodiments.

FIG. 17 is a simplified diagram 1700 illustrating the performance of the circuit illustrated in FIG. 15. It is to be appreciated that other variations are possible for staged LED string configurations. Other components, such as the current compensation module described above can be combined with the parallel LED string configuration.

As mentioned above, the staged parallel configuration can provide numerous advantages. More specifically, relatively low AC voltage can be used to power a large number of LED devices. The LED apparatus illustrated in FIGS. 15 and 16 can help reduce flickering. In various embodiments, the LED devices are specifically arranged in staged parallel configurations for reducing flickering of LED devices.

Now referring back to FIGS. 1 and 2 and the description above, such configurations for LED devices are inadequate in certain applications. In certain such applications, a string of LEDs has a number of intermediate taps or electrical connections dividing the series string into sub-strings. As illustrated in FIG. 1, there are 3 substrings composed of $n_1$, $n_2$, and $n_3$ LEDs per sub-string. As the AC line voltage increases from zero volts, first the $n_1$ string is turned on via the first FET1 regulated to a current $I_1$. As the voltage further increases, the first FET1 turns off while the second FET2 turns on power to both strings $n_1$ and $n_2$ to a current $I_2$. As the line voltage increases further, FET2 turns off and the third FET3 turns on thus powering string $n_1$, $n_2$, $n_3$ to a current $I_3$.

As an example, a possible LED package, as shown in FIG. 1, operating according to the discussed drive condition needs to set the current regulation to follow closely to sinusoid thus optimizing the power factor. For example, the LED package shown in FIG. 1 can have a power factor (PF) of 0.96. The light output flickers on/off at twice the rate of the line frequency. For example, the actual light output is the current multiplied by the # of LEDs. This makes the light output even more modulated than looking at the current alone as there are a higher number of LEDs in the later stages accompanied by high current.

In various embodiments, the present disclosure provides an LED circuit that is configured to invert the current by driving the initial stages harder than the final stages, which can help even out the light output. One possible formula for setting the current in each stage would be $$I\ (\text{stage } n) = I\ (\text{Final Stage}) \times (\text{total \# of LEDs in series}) / (\text{number of LEDs in stage } n)$$

This serves to set the current over the number of LEDs to be substantially equilibrated. An example of this implementation is shown below in FIG. 18.

TABLE 3

| Input | | | Stage 1 | | | | | Stage 2 | | | | | Stage 3 | | | |
|---|---|---|---|---|---|---|---|---|---|---|---|---|---|---|---|---|
| $V_{RMS}$ | $V_{Peak}$ | Freq | n | $I_{reg}$ | $I_{On}$ | $V_{reg}$ | $V_{On}$ | n | $I_{reg}$ | $I_{On}$ | $V_{reg}$ | $V_{On}$ | n | $I_{reg}$ | $I_{On}$ | $V_{reg}$ | $V_{On}$ |
| 12 | 17 | 60 | 1 | 45 | 50 | 3 | 3 | 3 | 85 | 45 | 11 | 10 | 4 | 165 | 85 | 16 | 14 |

TABLE 4

| Summary | | |
|---|---|---|
| M = | 1 | 9 |
| $V_{TRMS}$ | 12 V | |
| $I_{T\ RMS}$ | 105 mA | 945 mA |
| $I_{inst\ Ave}$ | 88 mA | 790 mA |

Figure 18:
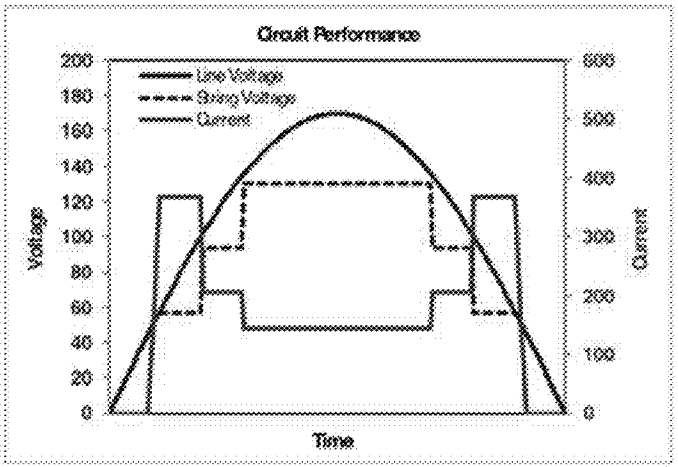
FIG. 18 depicts time charts, according to some embodiments.
Figure 19:
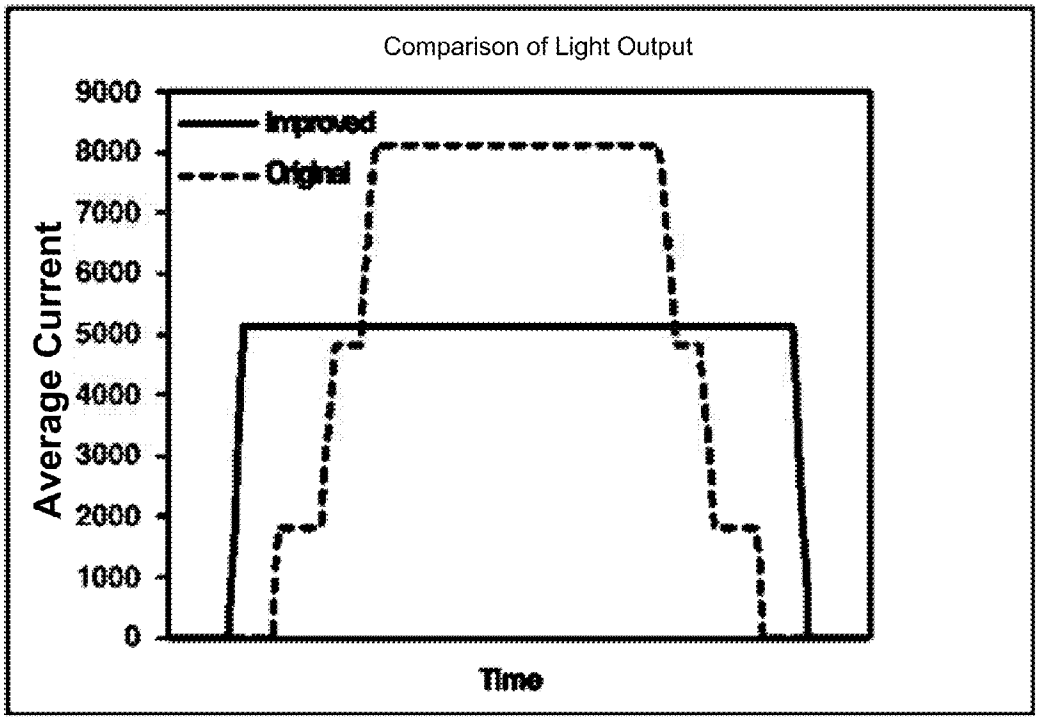
FIG. 19 depicts a light output comparison chart, according to some embodiments.

FIG. 18 depicts time charts 1800, and FIG. 19 depicts a light output comparison chart 1900. As shown, the power factor is reduced in exchange for a more linear, even light output. Among other things, the reduced power factor is 0.79 which is acceptable under the current Energy Star criteria of PF>0.7. The approximate light output of the two schemes are shown in FIG. 19. The improved method has a light output that is constant during the turn-on period.

In various embodiments, an LED package has a higher current per LED device for the initial stages than for the later stages. Depending on the application, a higher current level for the initial stage can be accomplished in various ways. More specifically, the LED package according to embodiments of the present disclosure is adapted to accommodate the higher current without substantially increasing current density. For example, current density (per area) can be reduced by using relatively larger LED packages. In certain embodiments, the amount of current per LED is reduced by arranging LED devices as parallel LED strings.

Figure 20A:
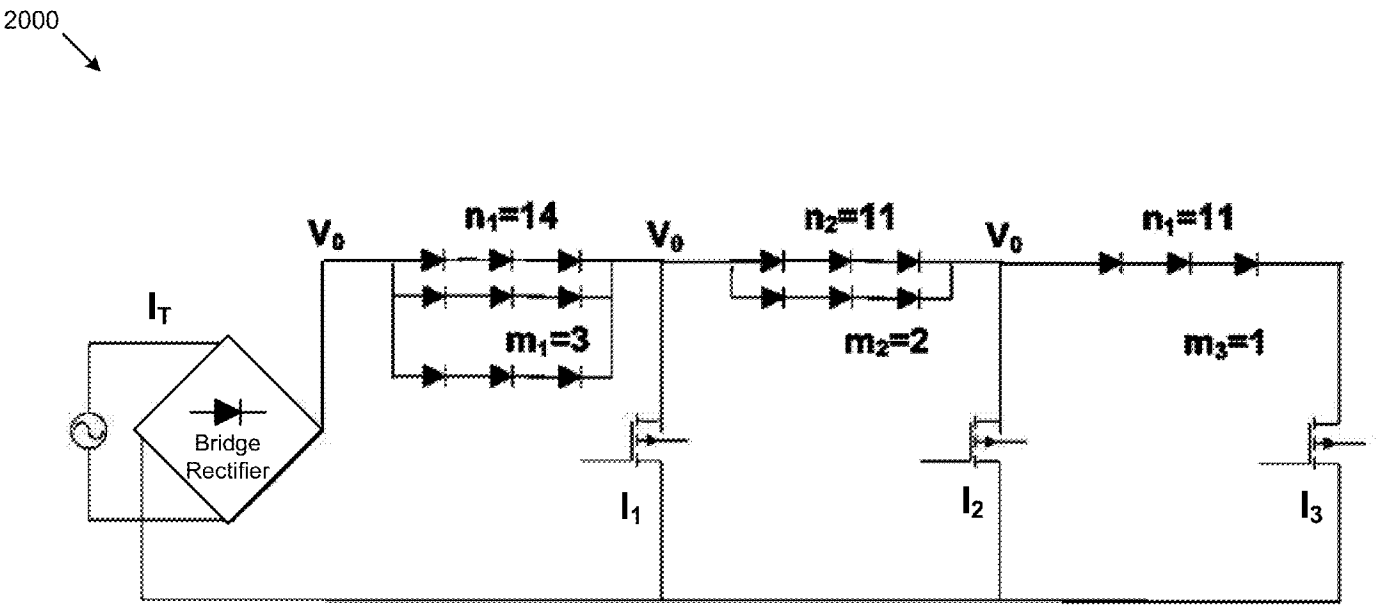
FIG. 20A is a simplified diagram illustrating an LED package with reduced current density, according to some embodiments.

FIG. 20A is a simplified diagram 2000 illustrating an LED package with reduced current density according to embodiments of the present disclosure. This diagram is merely an example and should not unduly limit scope of the claims.

As shown in FIG. 20A, at the first stage $n_1$, current is divided in m=3 strings. As a result, each of the LED devices at the first stage $n_1$ only receives ⅓ of the current going into the node $V_0$. Similarly, at the second stage, LED devices also receive a reduced amount of current. Depending on the application, the number of LED strings can be varied to achieve the desired current density at each stage.

In other embodiments, the overall spectrum emitted by the LED system can be tuned by the current management system. In these embodiments, the LEDs in different groups have different emission spectra. This is similar to the red-green-blue LED system of FIG. 15 but the LEDs can have more general chromaticities. In some of these embodiments, the overall emitted spectrum is driven by the amplitude of the signal produced by the bridge rectifier: the amplitude of the signal determines which LED groups turn on. For instance, under low drive condition, only one LED group turns on during a part of the AC cycle. Under higher drive conditions, a second LED group turns on during a part of the AC cycle, and so on. This enables the emission spectrum to be tuned while dimming the system.

FIG. 20B1 and FIG. 20B2 are simplified diagrams illustrating the performance of a circuit driven by the amplitude of the signal produced by the bridge rectifier. There are 2 sub-strings of LED devices with differing emission spectra. As shown in FIG. 20B1, under low-drive conditions (e.g. when the system is dimmed) only the first LED string is turned on during part of the AC cycle, and the emitted spectrum is the spectrum of the first sub-string. Under higher drive conditions, and as shown in FIG. 20B2, the second LED string is turned on during part of the AC cycle, and the emitted spectrum is a mixture of the spectra of the two LED strings.

In some embodiments, this spectral tuning is employed to modify the correlated color temperature (CCT) of the emitted light. In some embodiments, the emitted light is substantially white under a variety of drive conditions. In some embodiments, the color of the light is substantially similar to that of a blackbody radiator or to a phase of sunlight, with a variety of CCTs. In some embodiments, the light intensity and CCT are matched so that upon dimming, the color and intensity of the emitted light substantially resemble that of a blackbody radiator. Thus, the "warm dimming" sensation of a blackbody radiator can be emulated. Strictly as an example, a white-light source whose correlated color temperature (CCT) varies with input current can be configured to enabling warm-dimming. By replacing the red, green, and blue LEDs that were described in FIG. 15 with groups of white LEDs (e.g., at least one LED that is wavelength-converted to emit a white light) that have different CCT values a white light source whose average CCT changes as a function of supplied current can be fabricated. One such embodiment is given in FIG. 35.

Thermal Management Using Heat Transfer

Various embodiments of the present disclosure provide an LED system that includes high emissivity surfaces for heat transfer. The LED lamp includes a high emissivity surface area that emits heat through, among other ways, black body radiation. A heat sink is attached to the LED package, and the heat sink is characterized by a thermal emissivity of at least 0.6.

As explained above, some LED lamp designs are inadequate in terms of thermal management. More particularly, certain retrofit LED lamps are limited by the heat sink volume capable of dissipating the heat generated by the LEDs under natural convection. In many applications, lamps are placed into an enclosure such as a recessed ceiling, and the running lamps can raise the ambient air temperatures to over 50 degrees Celsius. Some electronic assembly techniques and some LED lifetime issues limit the operating temperatures of the printed circuit board (PCB), which may include electronics for providing power to the LED, to about 85° C. At this temperature the emissivity of various surfaces typically plays only a small role in dissipating the heat. For example, based on the black body radiation equation and an approximately 10 $in^2$ surface area, heat sink temperature of 85° C., an ambient of 50° C., and emissivity of 0.7, the heat sink radiates about only 1.4 W.

High-intensity LED lamps may operate at a high temperature. For example, an MR-16 type of LED lamp can have an operating temperature of 150 degrees Celsius. At such junction temperatures, over 30 percent of the cooling power provided by the heat sink in an MR-16 LED lamp form factor can be provided by black body radiative cooling, while less than 70 percent is provided by ambient air convection from the ambient-air-exposed heat sink fins.

The energy transfer rate associated with the radiative cooling mechanism can be calculated from the Stefan-Boltzman equation:

$$\text{Powder Radiated}=A\epsilon\sigma(T_{hs}^4-T_a^4)$$

Where:

A is the area of the lamp that is exposed to the ambient.

$\epsilon$ is the thermal emissivity of the surface.

$\sigma$ is the Stefan-Boltzman constant.

$T_{hs}$ is the temperature in Kelvin of the heat sink surface.

$T_a$ is the temperature in Kelvin of the ambient seen by the surface of the heat sink.

In certain embodiments, various components such as electronics and LED packages are reliable and efficient at high temperatures to at least 120 degrees Celsius. However, the actual temperature at operation can be much higher, at which higher temperatures both the driver circuits and LED devices can be damaged. At such temperatures, a heat sink is often used to radiate heat and reduce the operating temperature. For example, at 120 degrees C., a heat sink may need to radiate 130% more heat than at 85 degrees C. or 3.3 W. At these temperatures, radiation plays an important role in heat dissipation, and thus high emissivity is desirable. Table 5 as shown illustrates the relationship between surface area, emissivity, temperature, and radiated power calculated from the Stefan-Boltzman equation.

TABLE 5

| A ($in^2$) | $\epsilon$ | $T_{hs}$ | $T_a$ | $P_{rad}$(W) |
|---|---|---|---|---|
| 10 | 0.7 | 85° C. | 50° C. | 1.42 |
| 10 | 0.7 | 120° C. | 50° C. | 3.32 |
| 10 | 0.9 | 120° C. | 25° C. | 4.27 |

Aluminum is one type of material for heat sinks. Its emissivity depends highly on its surface treatment. Table 6 below provides a table illustrating various emissivity levels for aluminum surfaces.

TABLE 6

| | Emissivity |
|---|---|
| Aluminum Commercial sheet | 0.09 |
| Aluminum Foil | 0.04 |
| Aluminum Commercial Sheet | 0.09 |
| Aluminum Heavily Oxidized | 0.2-0.31 |
| Aluminum Highly Polished | 0.039-0.057 |
| Aluminum Anodized | 0.77 |
| Aluminum Rough | 0.07 |

Often, LED lamps heat sinks are not optimized to maximize emissivity. For example, heat sinks for LED lamps often have polished surfaces, and often heat sink surfaces are untreated and characterized by thermal emissivity that can be significantly less than 0.5.

In various embodiments, LED lamps comprise thermal dissipation surfaces that have an emissivity of 0.77 or higher. For example, such surfaces comprise anodized aluminum that is characterized by an emissivity of 0.77.

Figure 21:
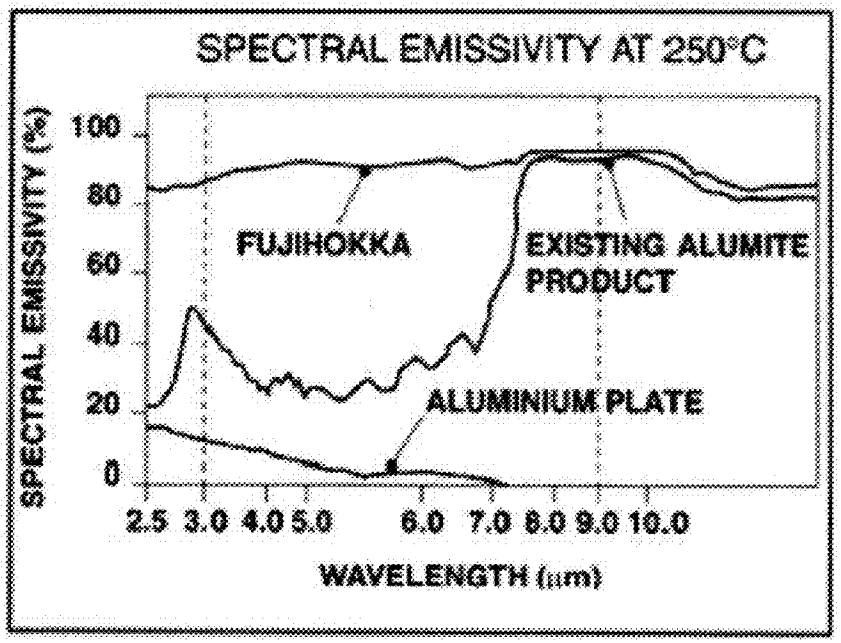
FIG. 21 is a simplified diagram illustrating emissivity level of anodized aluminum, according to some embodiments.

FIG. 21 is a diagram 2100 illustrating emissivity level of anodized aluminum (Fujihokka). In various embodiments, heat dissipating surfaces are coated with special materials to improve emissivity. For example, enhanced paint such as from ZYP Coating which includes $CR_2O_3$ or $CeO_2$, can provide an emissivity of 0.9. Alternatively coatings from Duracon can provide an emissivity of greater than 0.98. LED packages used in various lamp structures are designed to operate reliably at LED operating temperatures up to at least 150° C.

Figure 22:
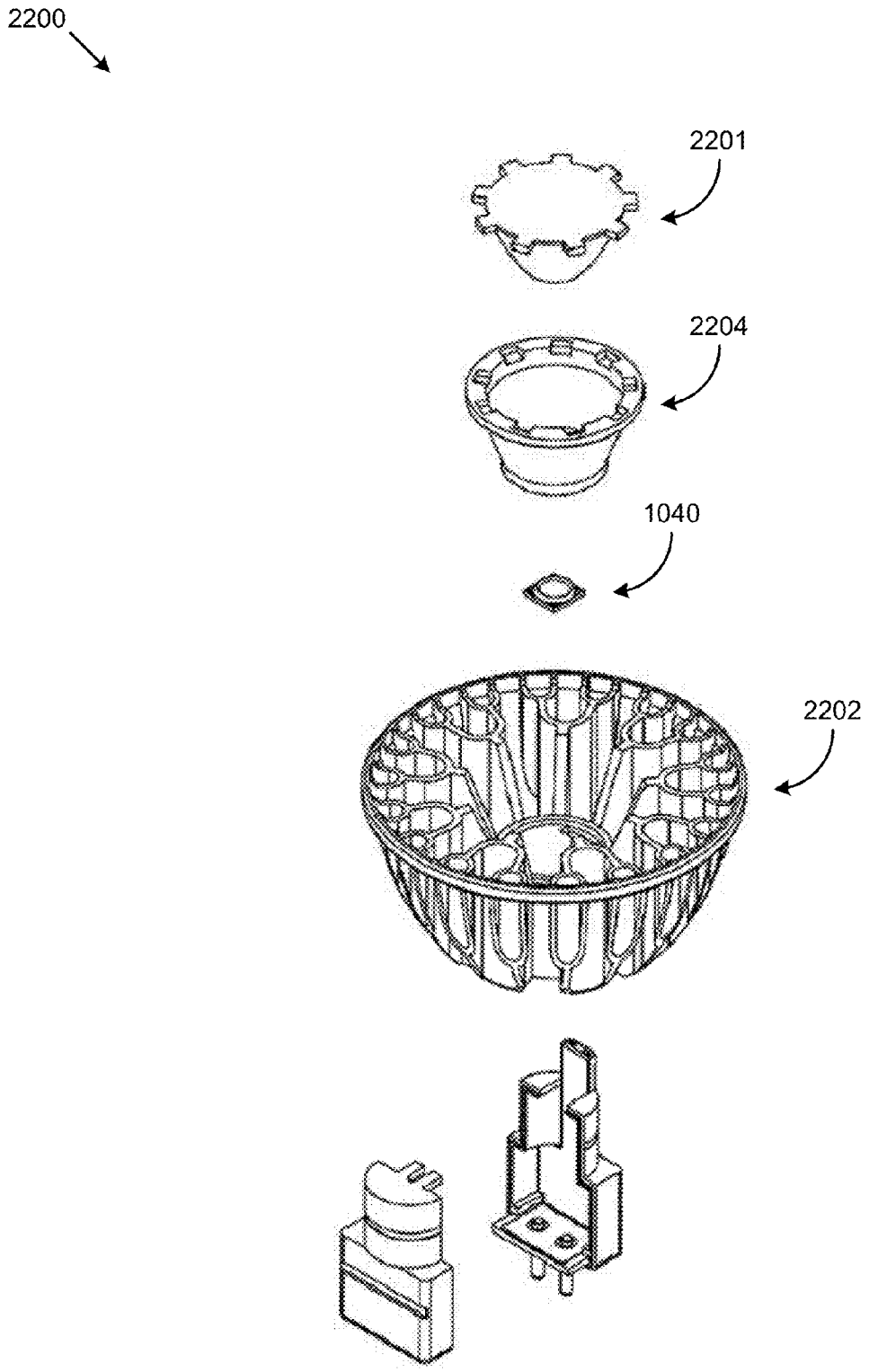
FIG. 22 is a simplified diagram illustrating an MR-16 LED lamp, according to some embodiments.

FIG. 22 is a diagram illustrating an LED lamp 2200 with an MR-16 type design. As shown, a heat sink 2202 is provided and one or more LED packages can be positioned on the surface. At high operating temperatures, over 30% of the cooling power is provided by the heat sink 2202. In an MR-16 LED lamp form factor providing blackbody radiative cooling, less than 70% of the cooling is provided by ambient air convection from the ambient-air-exposed heats ink fins. As explained above, the energy transfer rate associated with the radiative cooling mechanism can be calculated from the Stefan-Boltzman equation.

Figure 23:
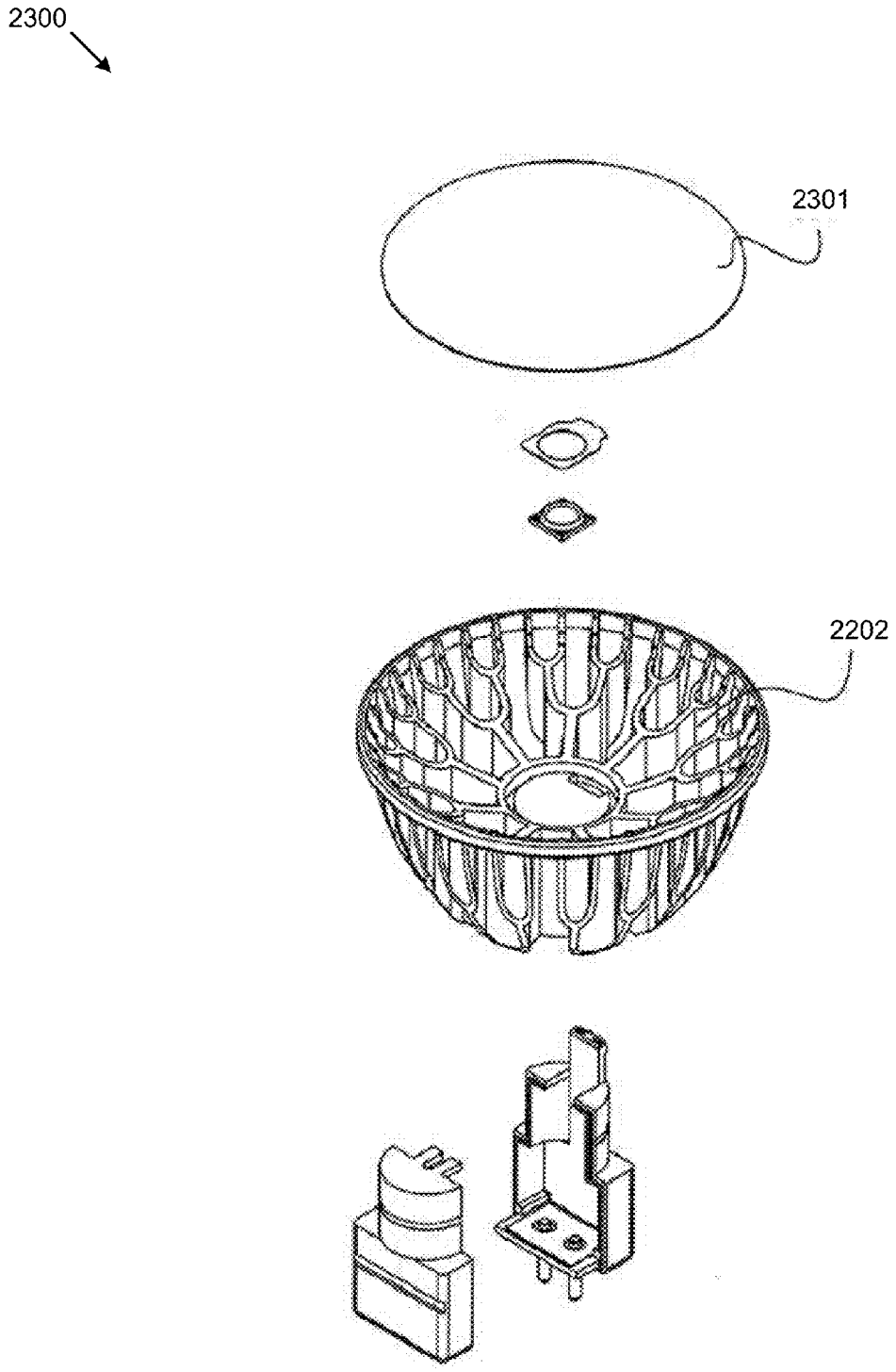
FIG. 23 is a simplified diagram illustrating an alternative LED lamp with MR-16 type of design, according to some embodiments.

FIG. 23 is a diagram illustrating an alternative LED lamp 2300 with an MR-16 type design. Similar to the LED lamp illustrated in FIG. 22, the LED lamp 2300 in FIG. 23 relies mainly on the heat sink 2202 to dissipate heat, and the surface can also be used for heat dissipation.

The importance of cooling process through radiative transfer increases rapidly as the LED operating temperature (and the resultant heat sink temperature) is increased. Altering the lamp design to optimize the effectiveness of this cooling process can contribute significantly to the overall power-handling capability of the lamp.

Various embodiments of the present disclosure provide a new LED lamp heat sink design, which maximizes cooling through radiative transfer. More specifically, LED lamp heat sink designs are useful for high-power (>3 W) LED lamps that will be placed in enclosures where the effectiveness of cooling through ambient air convection is limited. One approach is to treat or coat the exposed lamp heat sink surface to maximize its thermal emissivity, and then maximize the area of such a surface. A high-emissivity surface can be created by anodizing the surface of an aluminum heat sink or by coating the heat sink surface with a non-reflective black "paint." Ideally, the exposed lamp heat sink surface would have a thermal emissivity of at least 0.9, and, at a minimum, an emissivity of at least 0.6.

An LED lamp enclosed in a fixture where only the front surface of the lamp 2301 is exposed is an extreme, but potentially common, situation where perhaps the majority of the cooling power would be provided by radiative transfer from the front surface of the lamp. If the size of the optical lens element on such a lamp is minimized, the rest of the front surface of the lamp could be used as a high-emissivity radiative-transfer heat sink. An LED lamp can include a reflector fitted to a housing 2204.

Figure 24:
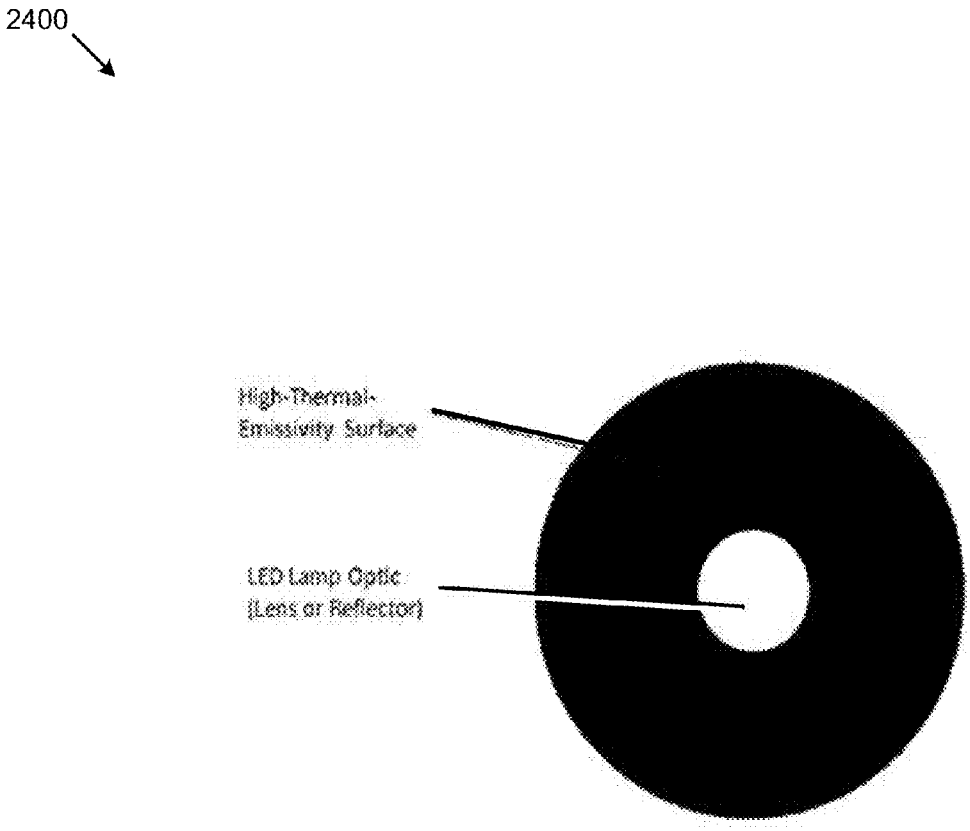
FIG. 24 is a simplified diagram illustrating a front surface of a high-radiative-transfer LED lamp according to an embodiment of the present disclosure.

FIG. 24 is a diagram illustrating a front surface 2400 of a substrate within a high-radiative-transfer LED lamp according to an embodiment of the present disclosure. As shown in FIG. 24, the front surface 2400 is in a substantially circular shape. An LED lamp and the optics thereof are positioned at the inner regions of the front surface 2400. The optic may include a lens and/or reflector. The outer region of the front surface 2400 includes a high-thermal emissivity surface. The substantially dark shade of the outer region is optimized for dissipating heat. In an embodiment, an outer region of the front surface has a high-emissivity coating (emissivity >~0.6) covering as large of a fraction as possible of the LED lamp's front surface area. As shown, the size of the optical element of the lamp (lenses, reflectors, or combinations thereof) is as small as possible for a given radiation pattern. Additionally, the thermal resistance between the LED and the front surface of the lamp are minimized as well.

Figure 25:
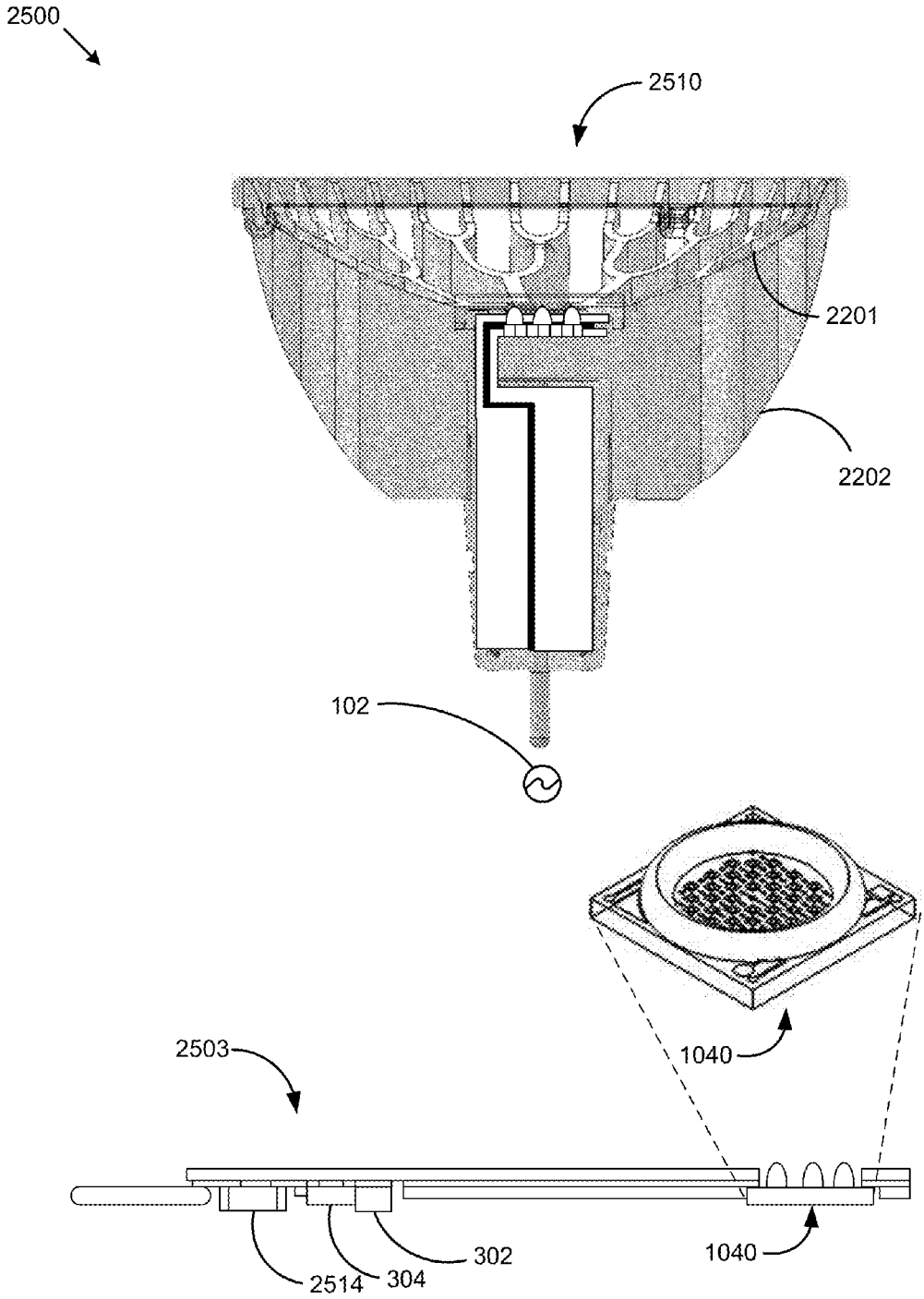
FIG. 25 is an illustration of a system comprising an LED lamp, according to some embodiments.

FIG. 25 is an illustration of an LED system 2500 comprising an LED lamp 2510, according to some embodiments. The LED system 2500 is powered by an AC power source 102 comprising a rectifier module 2514 (e.g., bridge rectifier 314) being configured to provide a rectified output to a first array of LED devices and a second array of LED devices potted into an LED package 1040. A current monitor module is electrically coupled to the first array and second array of LED devices such that the current monitor module can determine a first current level associated with the first array of LED devices and a second current level associated with the second array of LED devices; and a signal compensating module 304 electrically coupled to the current monitor module 302, the signal compensating module being configured to generate a first compensation factor signal based on a difference between the first current level and a first reference current level. As shown, the rectifier module 2514 and the signal compensating module (and other components) are mounted to a printed circuit board 2503. An LED submount 2201 has a front surface and a back surface, the front surface comprising an inner region and an outer region, and (as shown) LED die are disposed on the inner region of the submount. A heat sink 2202 has a thermal emissivity of at least 0.5.

Figure 26:
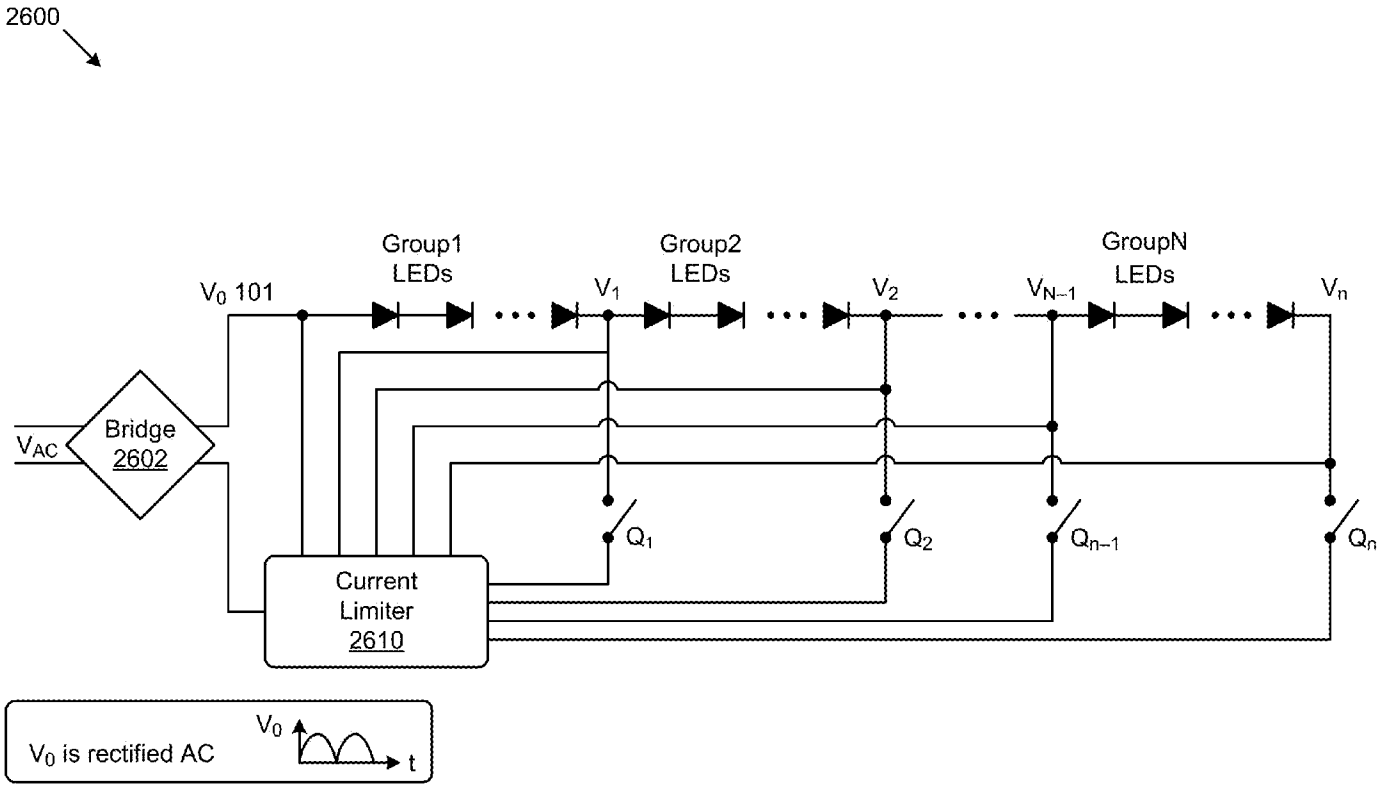
FIG. 26 is a schematic of a controller based on voltage sensing.

FIG. 26 is a schematic 2600 of a controller based on voltage sensing for implementing power control. Voltage sensing alone is sometime deficient in that LEDs used in illumination products need to connect to AC voltage sources such as 110V at 60 Hz (e.g., in USA) or 240V at 50 HZ (e.g., in many European countries). Yet, it is commercially expedient to produce a single illumination product design that can be installed in any country, and connected to any AC power source, and yet operate within a narrow specification for "constant lumen" light output (e.g., flicker-free, consistency over a long life, etc.).

Attempts to design such an illumination product with a single controller based on voltage sensing alone have failed in many regards. In particular, legacy designs exhibit wide variations in dissipated power.

As shown, a rectifier module (e.g., bridge 2602) is electrically coupled to the AC power source. The rectifier module is configured to provide a rectified output. This embodiment implements a voltage-sensing, current limiting approach that detects V0 waveform and switches more LED groups (LED1, LED2, . . . LEDn) into operation when V0 rises. When V0 falls, the controller switches fewer groups into operation. Alternatively, the shown controller detects LED node voltages (V1, V2, . . . Vn) or current in Q1 . . . Qn. A current limiting switch controller (e.g., current limited 2610) switches in more LED groups into operation when the node voltage or current exceeds a pre-programmed threshold.

A voltage-sensing controller can measure line voltage from V0, and use the magnitude of V0 to adjust current thresholds through Q1 . . . Qn such that system power remains constant when VAC varies.

Figure 27:
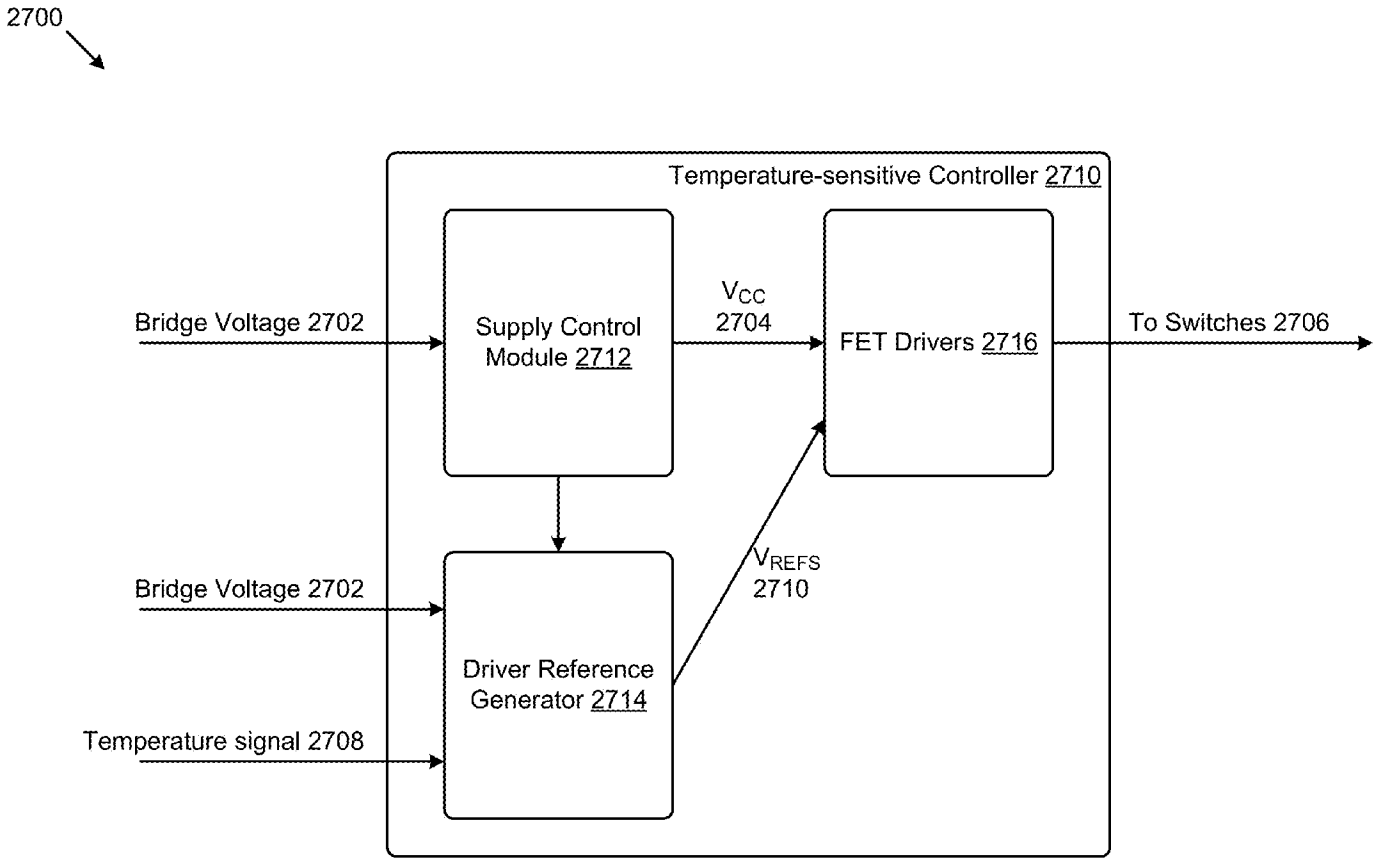
FIG. 27 is a block diagram of a controller based on temperature sensing for implementing a direct line LED lamp controller with temperature-sensing power control, according to some embodiments.

FIG. 27 is a block diagram 2700 of a temperature-sensitive controller based on temperature sensing for implementing a direct line LED lamp controller with temperature-sensing power control. As an option, the present block diagram 2700 may be implemented in the context of the architecture and functionality of the embodiments described herein. The block diagram 2700 or any aspect therein may be implemented in any desired environment.

Implementations according to this embodiment involve a temperature-sensing approach. The temperature-sensitive controller employs a temperature signal 2708 generated from a device (e.g., a negative temperature coefficient thermistor, a positive temperature coefficient thermistor, or a thermal couple conditioned by an integrated circuit) for measuring temperatures and/or changes in temperatures. In the embodiment shown, components comprising the temperature-sensitive controller 2710 include a supply control module 2712 The supply control module 2712 inputs bridge voltage 2702, and regulates power to LEDs so as to produce a constant temperature as measured at various places in the lamp. The power to the LEDs is governed by adjusting current thresholds through the switches (e.g., FETs). As shown, set of FET drivers 2716 operate base on a Vcc level 2704 and a set of reference voltages $V_{REFS}$ 2710, which reference voltages are generated by a driver reference generator 2714.

Figure 28:
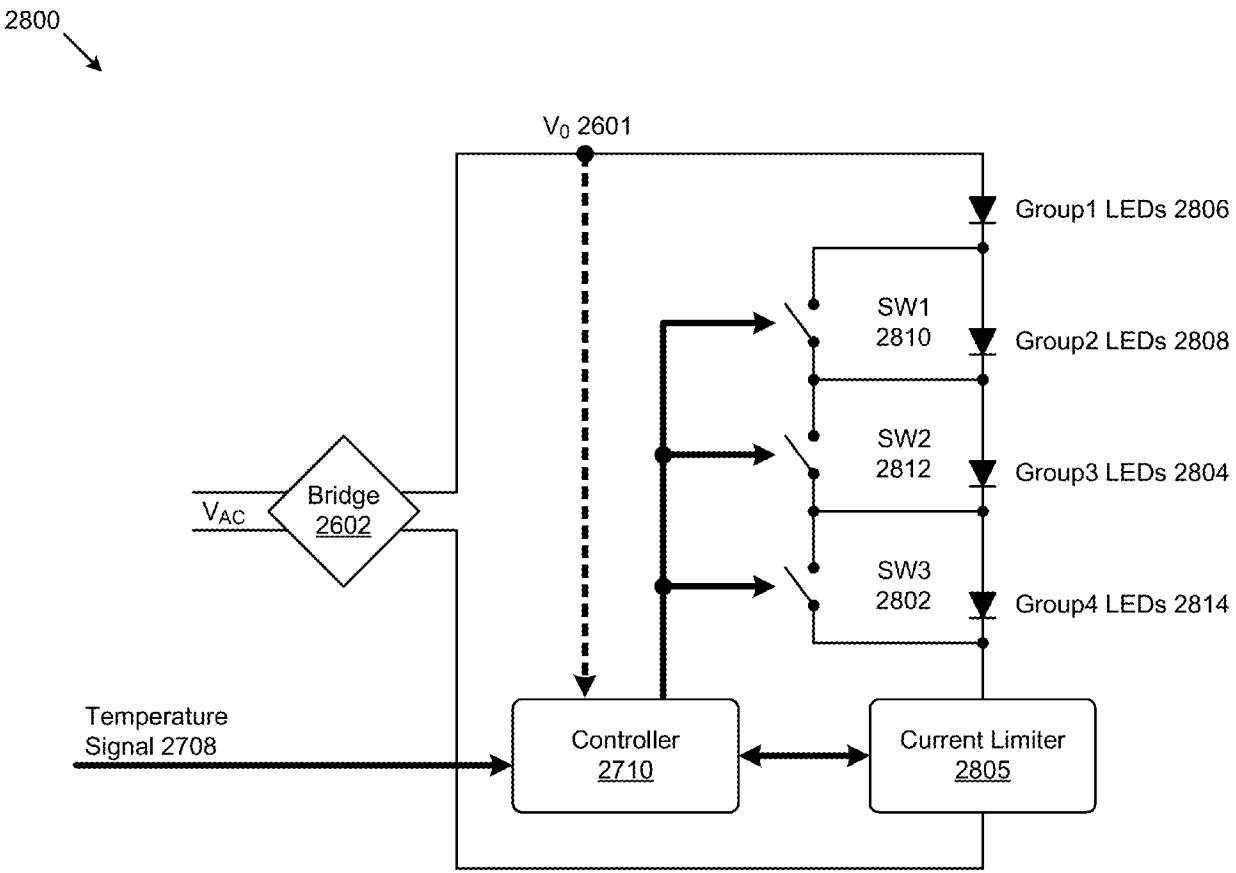
FIG. 28 is a schematic of a temperature-sensitive controller that includes current regulation.

FIG. 28 is a schematic 2800 of a controller based on a temperature signal 2708 for implementing power control. As an option, the present schematic 2800 may be implemented in the context of the architecture and functionality of the embodiments described herein. The schematic 2800 or any aspect therein may be implemented in any desired environment.

As shown, SW1 2810, SW2 2812, and SW3 2802 are binary on/off switches. The current limiter $\mathbf{2805}_2$ in the series path controls the current for implementing power control to groups of LEDs (e.g., Group1 LEDs 2806, Group2 LEDs 2808, Group3 LEDs 2804, Group4 LEDs 2814,). The controller can sense temperature and voltage $V_0$ and/or the current. It can control LED current or power to a constant level.

Figure 29:
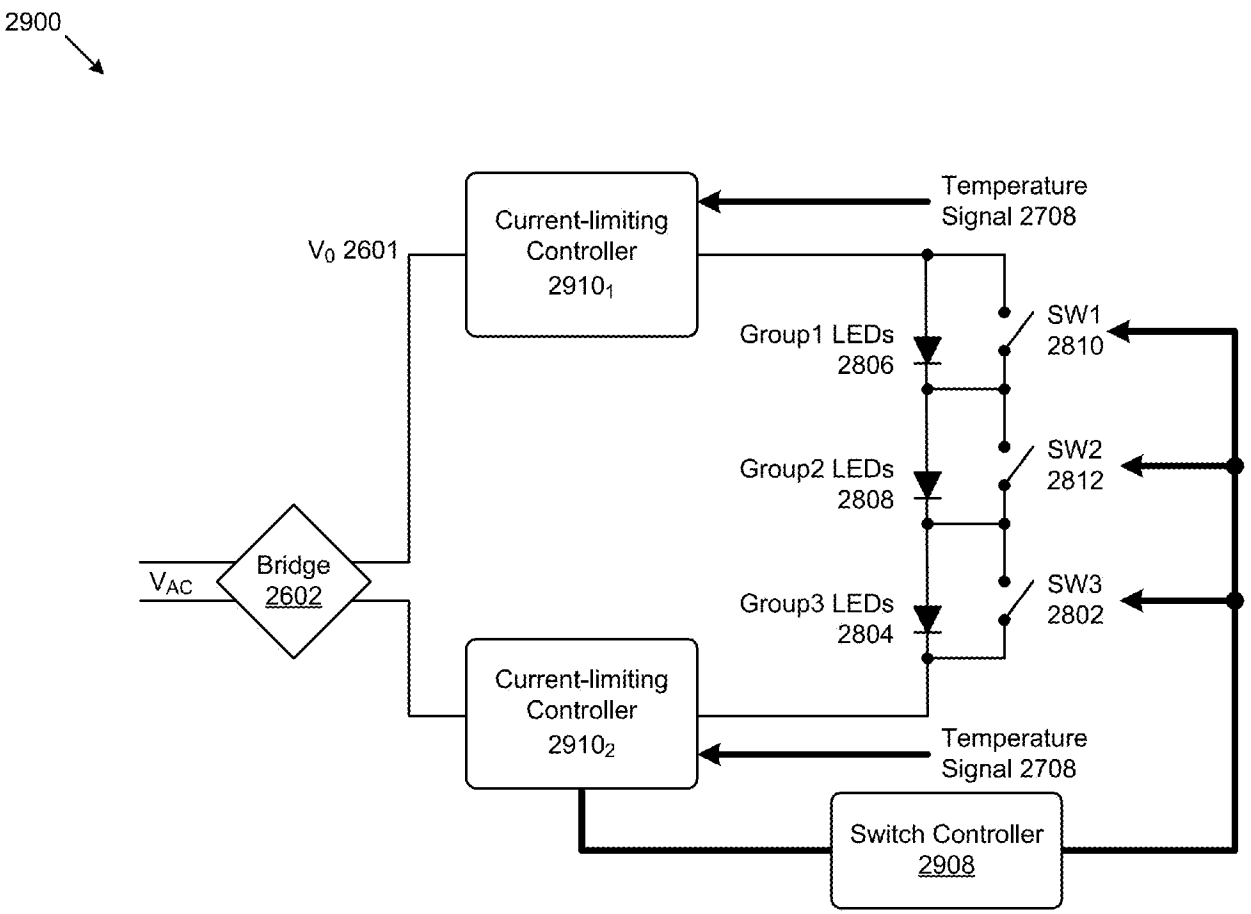
FIG. 29 is a schematic of a current-limiting temperature-sensitive controller based on temperature sensing for implementing a direct line LED lamp controller with temperature-sensing power control, according to some embodiments.

FIG. 29 is a schematic 2900 of a current-limiting temperature-sensitive controller based on current limits and temperature sensing for implementing a direct line LED controller with temperature-sensing power control. As an option, the present schematic 2900 may be implemented in the context of the architecture and functionality of the embodiments described herein. The schematic 2900 or any aspect therein may be implemented in any desired environment.

Switches SW1 2810, SW2 2812, and SW3 2802 are on/off switches. Current limiters in the series path can control the current. The temperature-sensitive aspects of the current-limiting controllers (e.g., current-limiting controller $\mathbf{2901}_1$, current-limiting controller $\mathbf{2901}_2$) can sense temperature and voltage $V_0$ and/or current. It can control LED current or power to a constant level. An alternative approach involves a temperature-sensitive controller that senses the temperature and controls the temperature to a pre-defined constant by adjusting the current delivered to different groups of LEDs.

Figure 30:
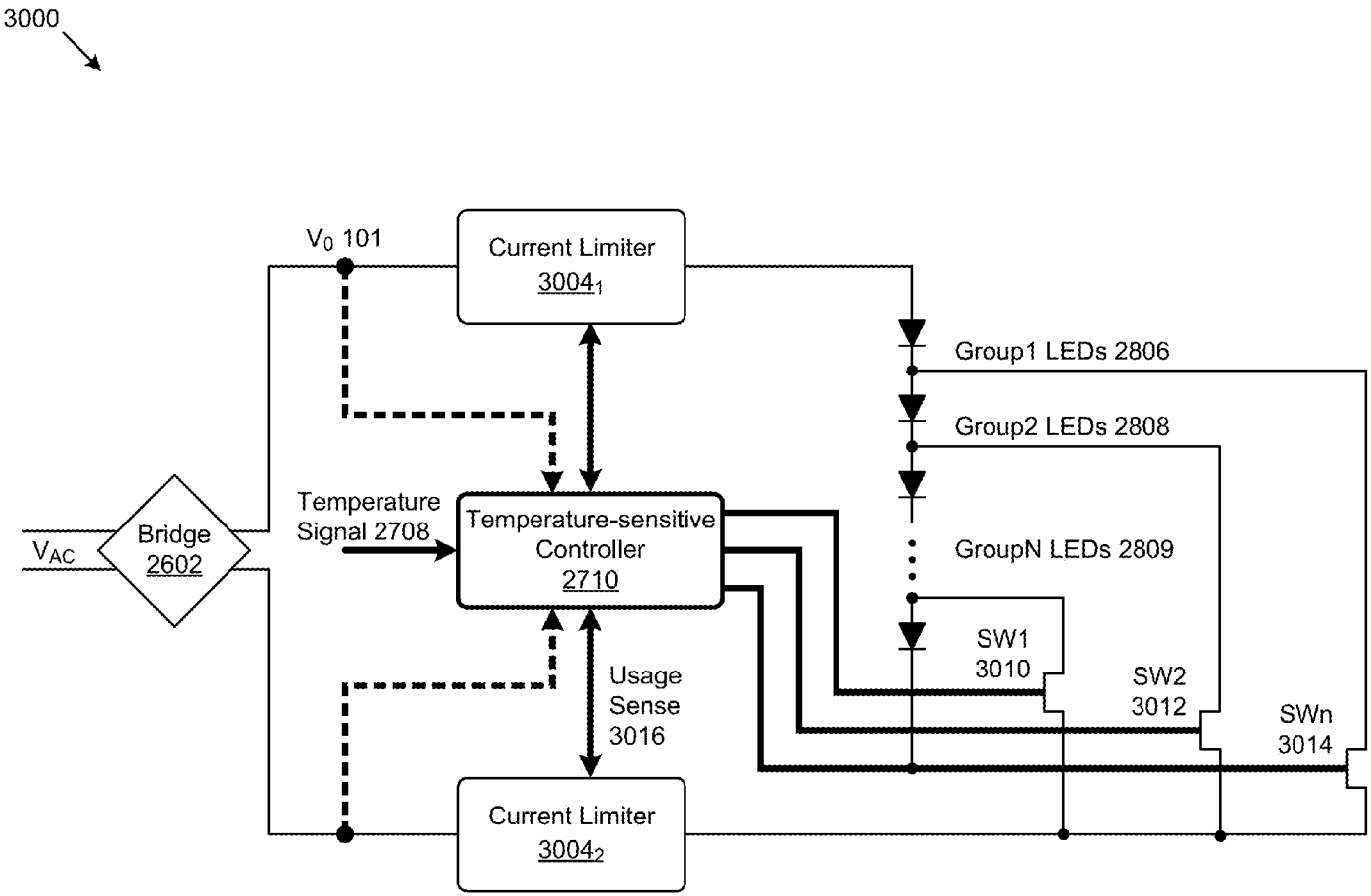
FIG. 30 is a schematic showing alternative locations of a current-limiting temperature-sensitive controller in conjunction with on/off switches.

FIG. 30 is a schematic 3000 showing alternative locations of a current-limiting temperature-sensitive controller in conjunction with transistor switches (e.g., SW1 3010, SW2 3012, SWn 3014) for implementing power control to groups of LEDs (e.g., Group1 LEDs 2806, Group2 LEDs 2808, GroupN LEDs 2809. As an option, the present schematic 3000 may be implemented in the context of the architecture and functionality of the embodiments described herein. The schematic 3000 or any aspect therein may be implemented in any desired environment. As shown, the schematic 3000 controls current-limiting transistors using a temperature-sensitive controller.

Figure 31:
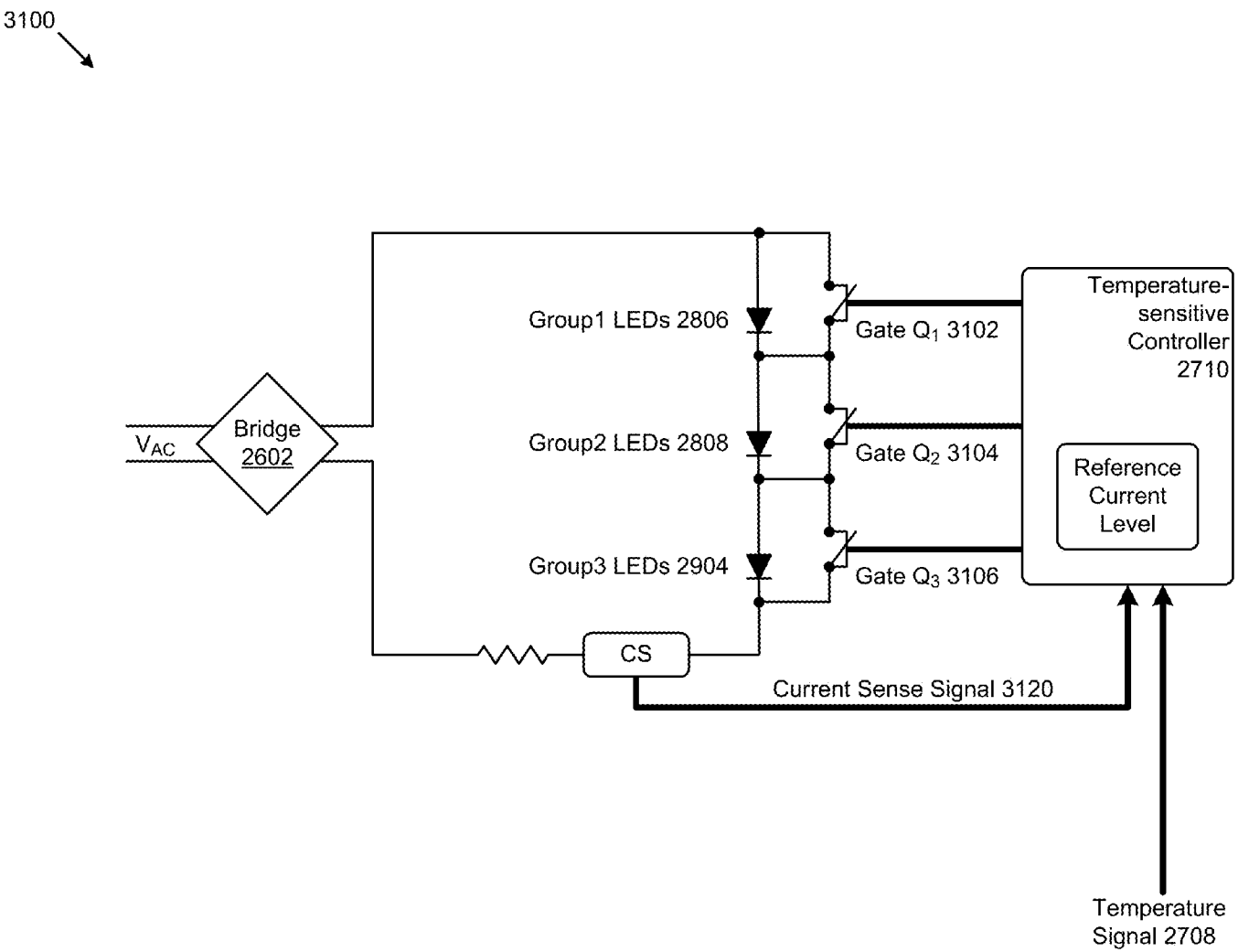
FIG. 31 is a schematic showing a current-limiting temperature-sensitive controller in conjunction with transistors.

FIG. 31 is a schematic 3100 showing an alternative current-limiting temperature-sensitive controller in conjunction with switches (e.g., gate Q1 3102, gate Q2 3104, gate Q3 3106) for implementing power control. As an option, the present schematic 3100 may be implemented in the context of the architecture and functionality of the embodiments described herein. The schematic 3100 or any aspect therein may be implemented in any desired environment.

As shown, the schematic 3100 exhibits a current-limiting temperature-sensitive controller using transistors for controlling current through the LEDs. LED group 1 to 3 can each consist of different numbers of LEDs in series. Depending on a measured current level (see current sense signal 3120), the temperature-sensitive controller is able to select appropriate LED groups to be powered. As one example, not all LED groups should be bypassed by switches.

Figure 32:
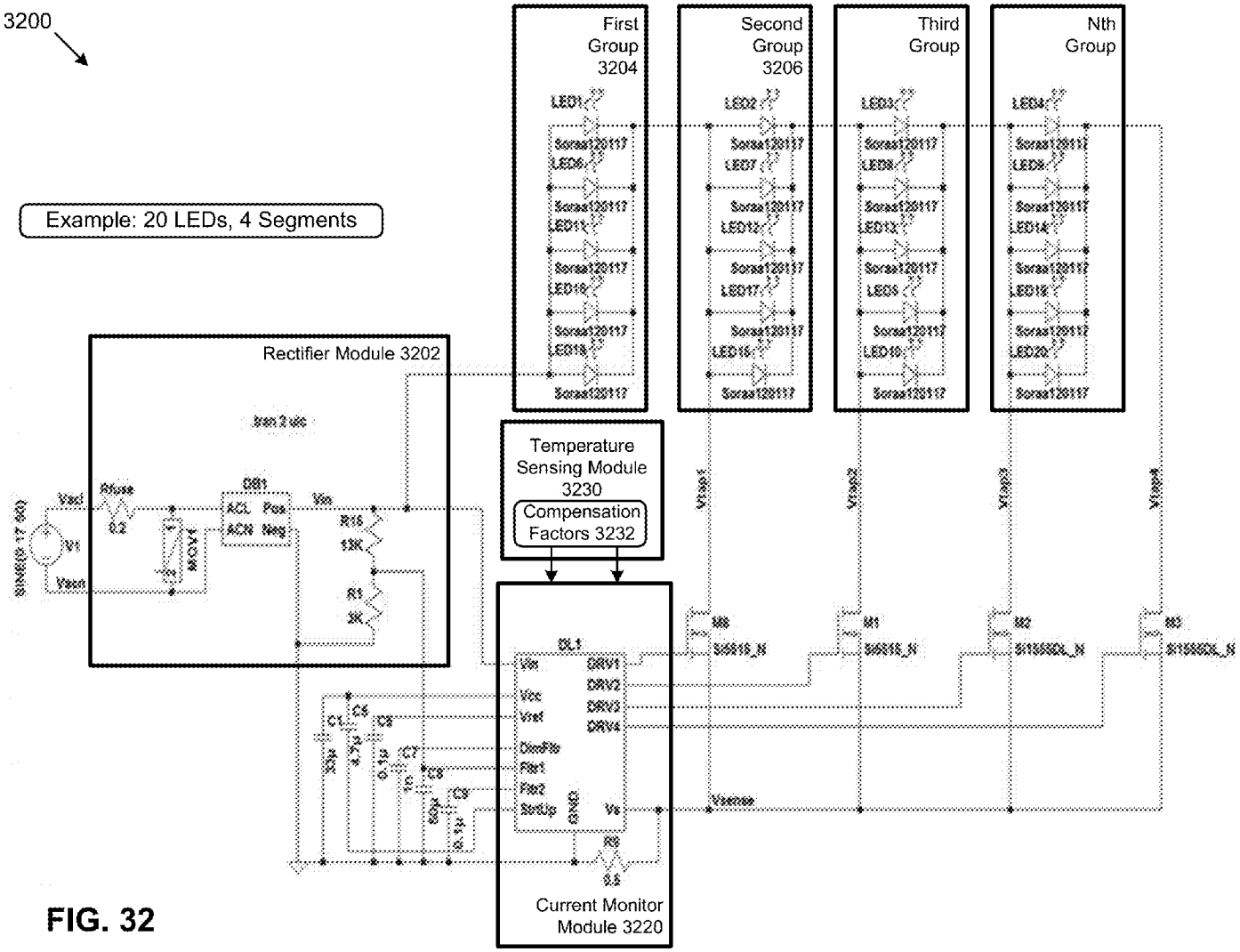
FIG. 32 is a circuit including a controller based on temperature sensing for implementing a direct line LED lamp controller, according to some embodiments.

FIG. 32 is a circuit 3200 including a controller based on temperature sensing for implementing a direct line LED lamp controller with temperature-sensing power control. As an option, the present circuit 3200 may be implemented in the context of the architecture and functionality of the embodiments described herein. The circuit 3200 or any aspect therein may be implemented in any desired environment.

When integrated in or with an LED lamp, the resulting embodiment implements an LED system for coupling to an AC power source. Constituent components include:

- a rectifier module 3202 being electrically coupled to the AC power source, the rectifier module being configured to provide a rectified output;
- a first group of LED devices 3204, the first group of LED devices being electrically coupled to the rectifier module and to receive the rectified output;
- a second group of LED devices 3206 electrically coupled to the first group of LED devices;
- a current monitor module 3220 electrically coupled to the first group and second group of LED devices, the current monitor module being configured to determine a first current level using a drawn current level signal associated with the first group of LED devices and a second current level using a reference current level signal associated with the second group of LED devices; and a temperature sensing module 3230 electrically coupled to the current monitor module, the temperature sensing module being configured to generate compensation factors based at least in part on a temperature.

In some embodiments the output of the rectifier is a simple AC-rectified waveform. However in other embodiments the output of the rectifier is another rectified waveform. This includes a non-sinusoidal waveform, as well as a constant waveform (in which case the rectifier has as an AC to DC function).

Figure 33:
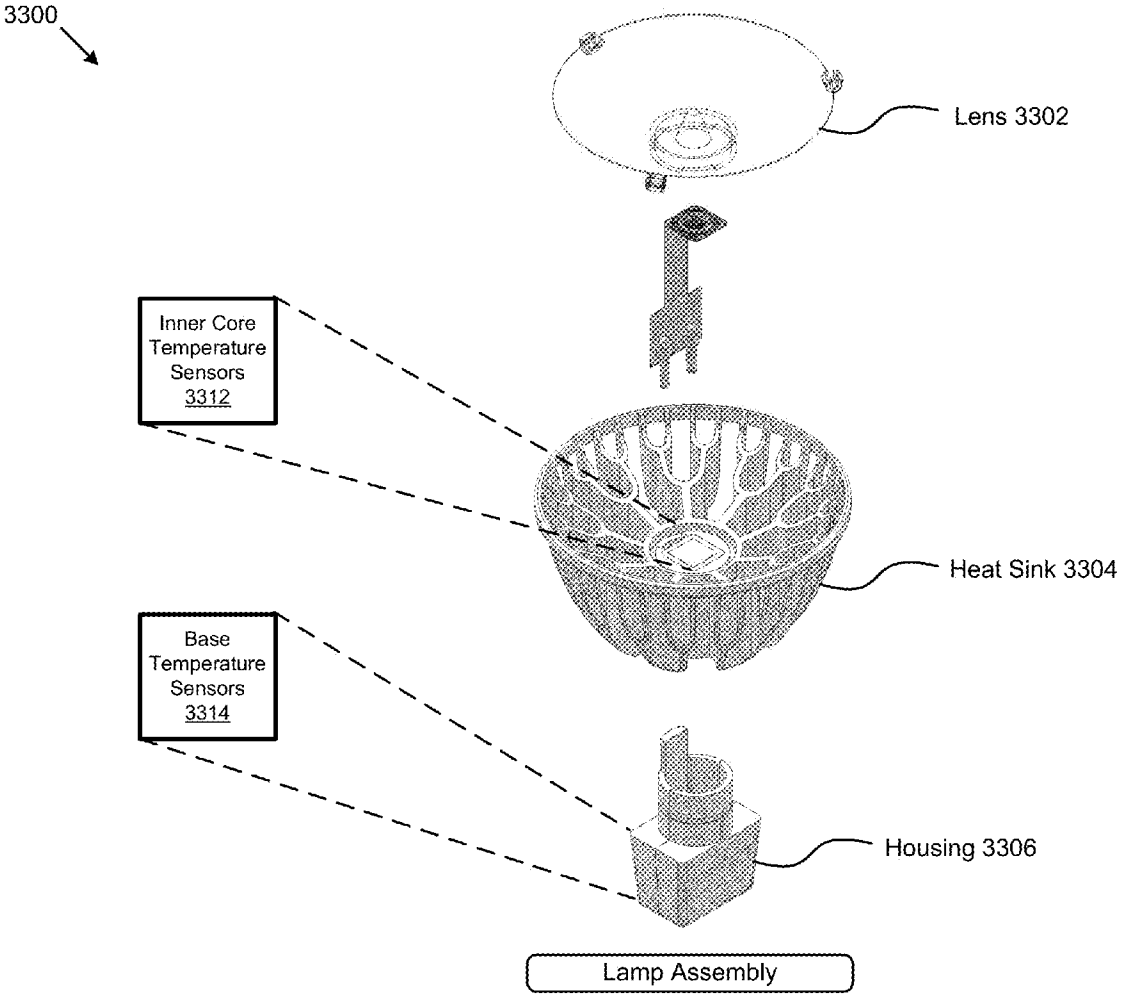
FIG. 33 is an exploded lamp assembly view of an LED lamp, according to some embodiments.

FIG. 33 is an exploded lamp assembly view 3300 of an LED lamp showing a lens 3302, housing, a heat sink 3304, and a housing 3306 into which heat sink or housing can serve as a mount for some portions of the aforementioned temperature-sensitive controllers can be housed.

Strictly as examples, the heat sink can serve as a mounting for inner core temperature sensors 3312. Or, the base housing can serve as a mounting for base temperature sensors 3314.

Figure 34:
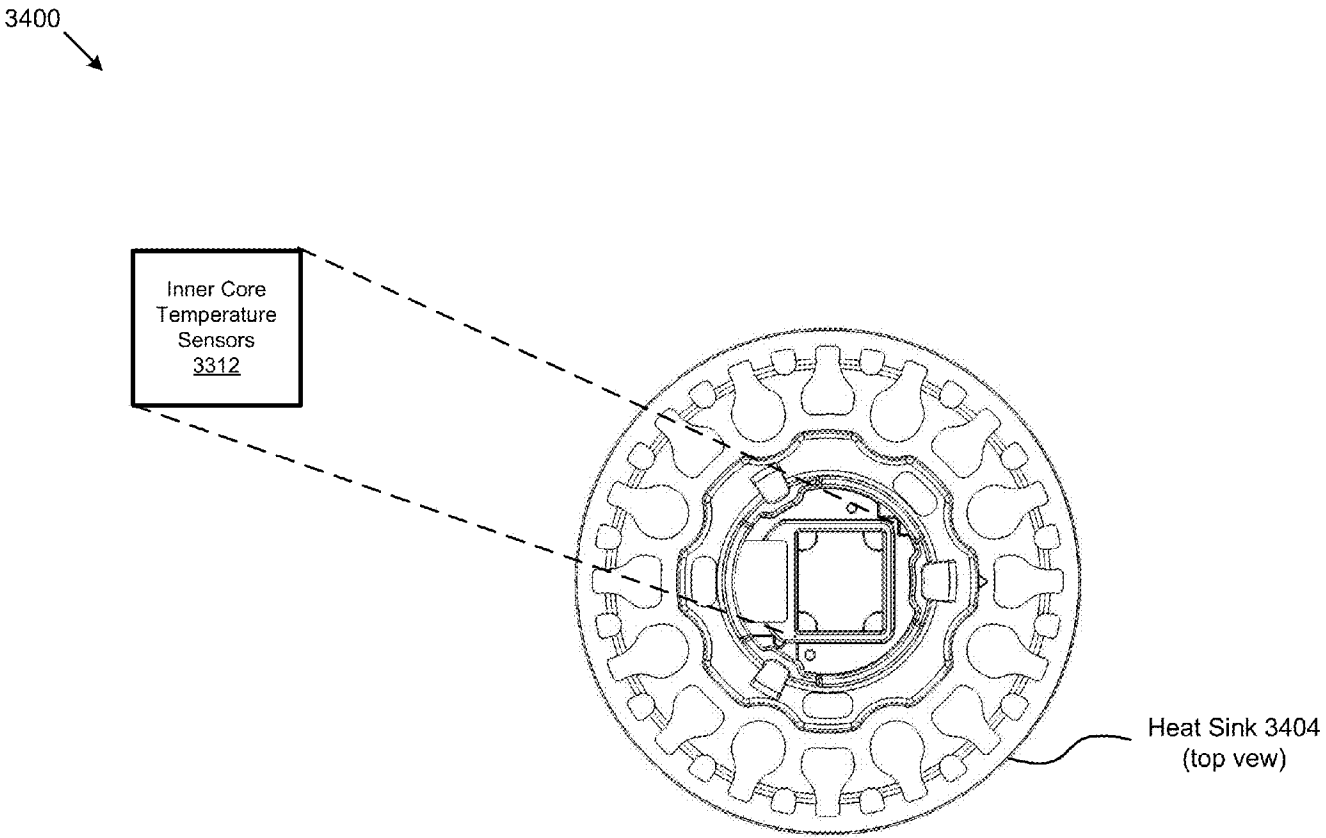
FIG. 34 is a top view of an LED lamp heat sink, according to some embodiments.

FIG. 34 is a top view of an LED lamp heat sink 3404. Strictly as one example, the inner core of the heat sink can serve as a mounting for inner core temperature sensors 3312.

Figure 35:
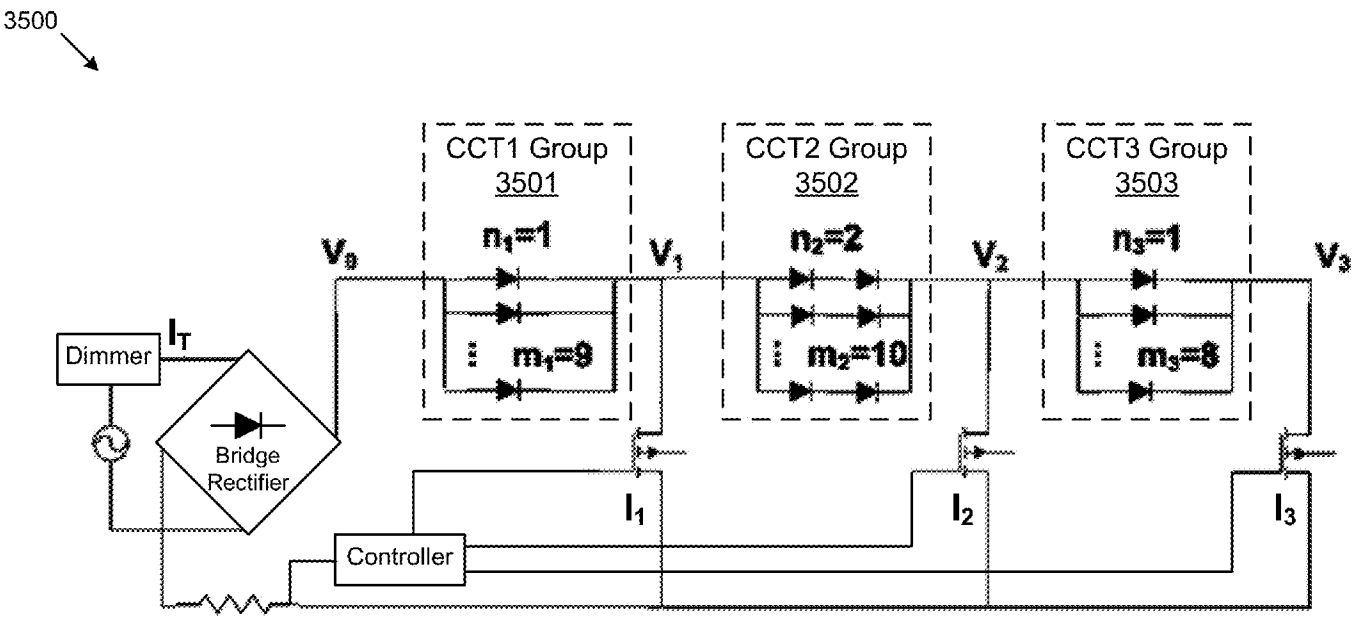
FIG. 35 depicts an apparatus for creating a white light source that changes correlated color temperature (CCT) as the input power is varied according to some embodiments.

FIG. 35 depicts an apparatus for creating a white-light source whose correlated color temperature (CCT) varies with input current. FIG. 35 is a specific example of a system enabling warm-dimming. By replacing the red, green, and blue LEDs that were described in FIG. 15 with groups of white LEDs (e.g., at least one LED that is wavelength-converted to emit a white light) that have different CCT values (e.g., CCT1 group 3501, CCT2 group 3502, and CCT3 group 3503), a white light source whose average CCT changes as a function of supplied current can be fabricated. Management of the groups forming such an apparatus could follow a regime for changing the color mixture as the input current is changed. For example, given CCT3>CCT2>CCT1 the combination can exhibit an average CCT that falls as the input current is reduced, thus emulating the CCT variation with respect to input current as is typically exhibited by an incandescent bulb.

In embodiments where the spectrum is tuned by mixing LED subsets, the choice of the spectra of each LED subset is important as it determines the possible gamut of the system. If the system comprises 3 LED groups with different spectra, the possible gamut in the 1931 CIE color space is a triangle whose apexes are the color coordinates of the 3 LED groups.

Figure 36:
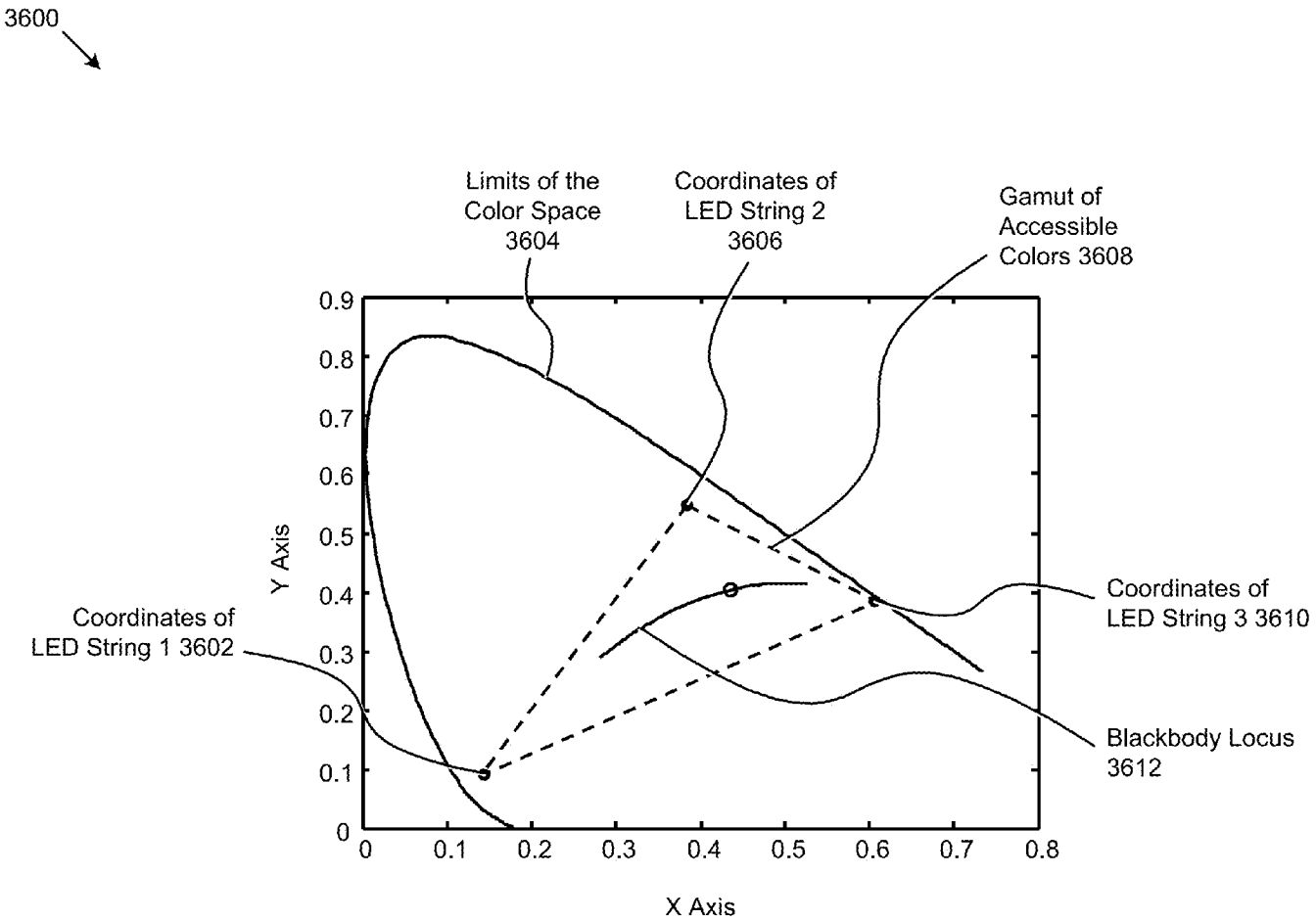
FIG. 36 shows a CIE color space, according to some embodiments.

FIG. 36 shows the 1931 CIE color space (see limits of color space 3604). Also shown are the locus of blackbody radiators 3612 in a wide range of CCTs, the color coordinates of 3 LED strings and the gamut of accessible colors 3608 accessible by tuning the relative contribution of each string. In this case, the gamut encompasses the blackbody locus: therefore, white spectra within the corresponding CCT range can be produced.

In some cases, a wide gamut is desirable. In such cases, the color coordinates of the LED strings can be placed far apart. This can be achieved, for instance, by using a blue-emitting string, a green-emitting string and a red-emitting string (see LED string 1 3602, LED string 2 3606, and LED string 3 3610).

In other cases, it is desirable to maintain the color difference between strings at a low level. This can be the case for spot lamps where color uniformity in the beam is desirable: in such cases, the beam color can be non-uniform if the LED strings have very different colors. Therefore, one approach is to determine the minimum desirable gamut (for instance, a gamut which encompasses a blackbody locus in a given CCT range) and select LED colors which enable this minimal gamut, but not a larger gamut. This ensures that all the desired spectra can be generated and that the color difference between the strings is minimized. In some cases, the maximum tolerable color difference between the LEDs can be expressed by a maximum distance in a color space, such as the well-known color difference Du'v'.

Figure 37:
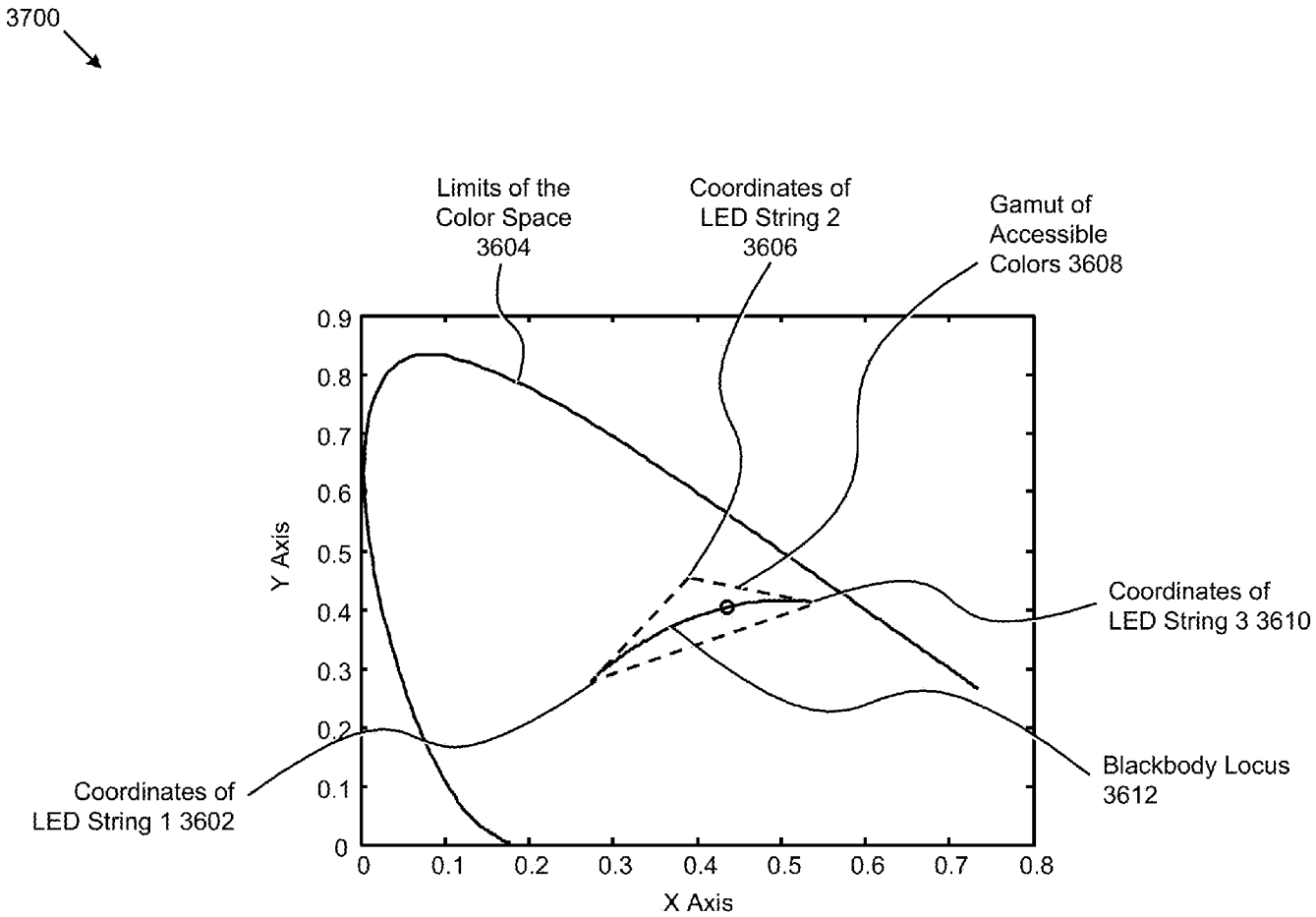
FIG. 37 shows a system having LED strings have similar colors, according to some embodiments.

FIG. 37 relates to FIG. 36 in that it shows a system where the LED strings have rather similar colors, while still encompassing the same blackbody locus. FIG. 36 and FIG. 37 illustrate the tradeoff between sources that can produce a wide gamut, and sources whose LED strings have a small color difference.

In order to minimize color non-uniformity in the beam, one can combine two techniques: (1) limiting the color difference between LED strings (as just described) and (2) spatially interweaving the LEDs from different strings as already shown on FIG. 10.

The following figures further discuss techniques to address color uniformity.

Figure 38:
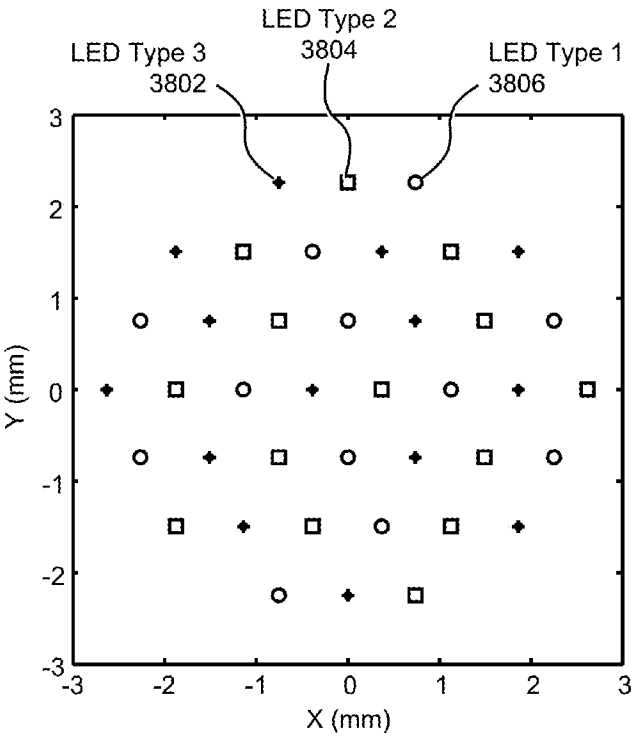
FIG. 38 depicts x-y coordinates of 3 groups of die on an LED light chip, according to some embodiments.

FIG. 38 depicts x-y coordinates of 3 groups of dies on an LED light chip. The exemplary system comprises 40 LEDs among the 3 groups each of a different type (see LED type 3 3802, LED type 2 3804, LED type 1 3806), where the individual die are interspersed so as to be evenly distributed in the x-y plane. Each group has a different emission spectrum. The light chip has a diameter of about 6 mm, and can be placed in an MR-16 spot lamp.

Figure 39B:
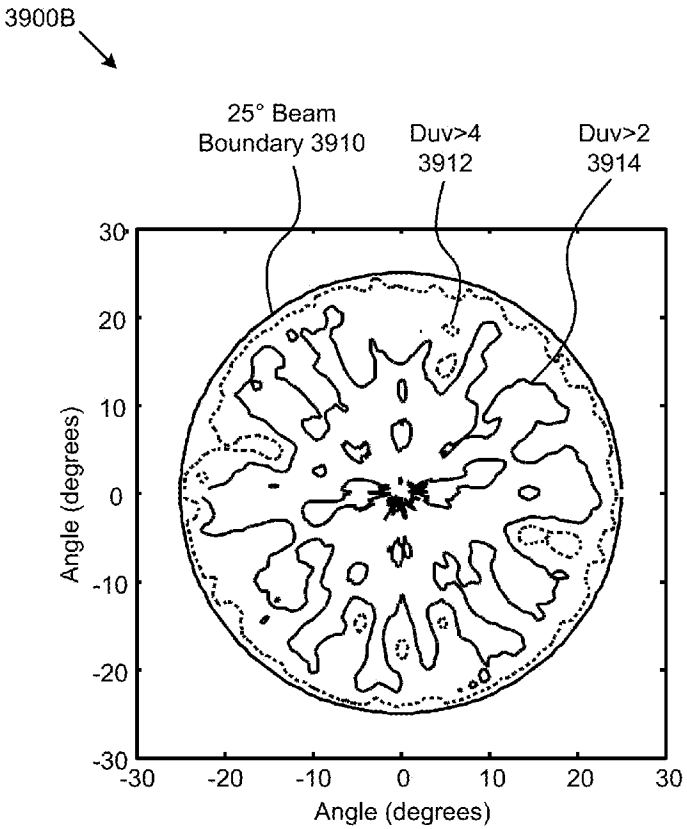
FIG. 39A and FIG. 39B illustrate color uniformity resulting from a specific choice of emission spectra, according to some embodiments.
Figure 39A:
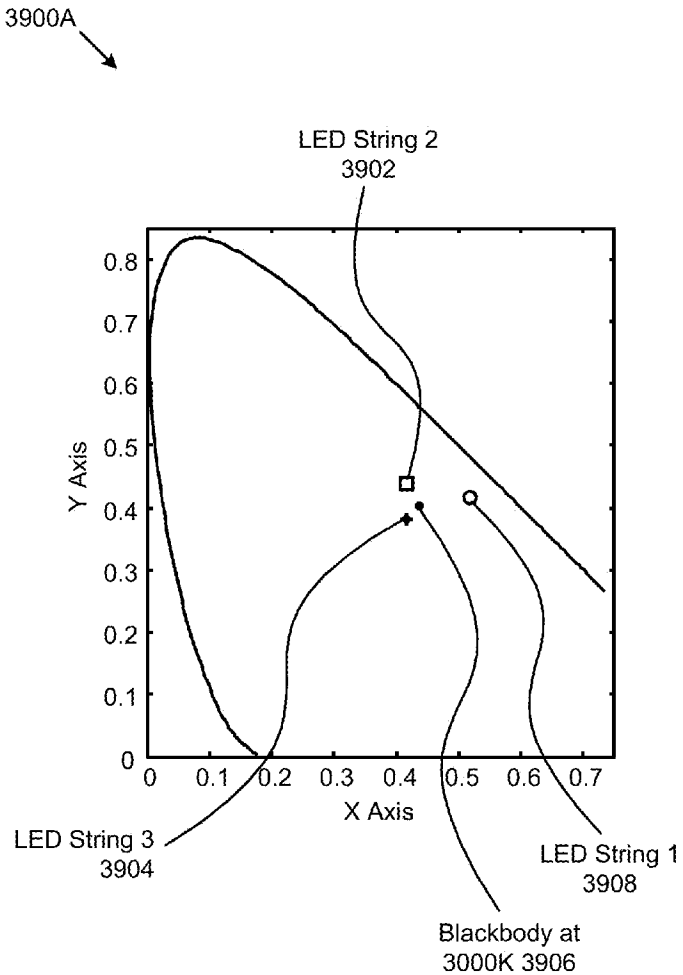

FIG. 39A and FIG. 39B illustrate color uniformity resulting from a specific choice of emission spectra. FIG. 39A shows the CIE 1931 color space 3900A, where the color coordinates of the 3 LED groups are indicated. The coordinates of a 3000K blackbody are also shown (see blackbody at 3000K 3906). The 3 LED groups (see LED string 1 3908, LED String 2 3902, and LED string 3 3904) have color coordinates rather close to the blackbody point—they correspond to rather white spectra. FIG. 39B shows the resulting color uniformity in the angular far-field pattern 3900B. This figure was obtained by modeling: using a raytracing software tool, The light chip was combined with a 25° MR-16 spot lens. The respective intensities of the 3 LED groups were set so that the lamp's color coordinates match the 3000K blackbody. The far-field emission diagram was computed, yielding the angular far-field pattern 3900B. The figure shows contour lines corresponding to specific values of color difference Du'v' across the beam. Du'v' reaches values of about 2 (see Du'v'>2 3914) and about 4 (see Du'v'>4 3912), but is below 6 in the 25° beam boundary 3910.

Figure 40B:
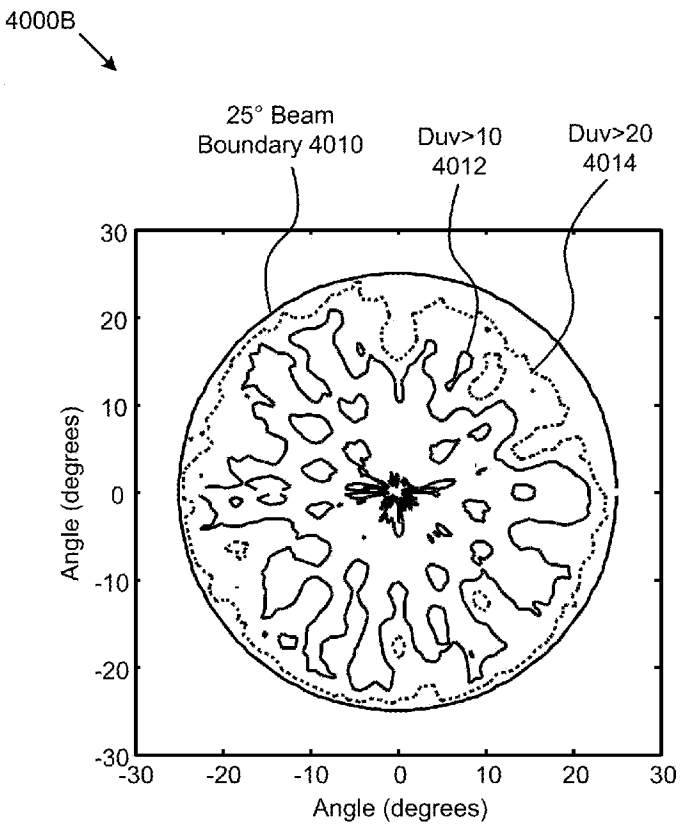
FIG. 40A and FIG. 40B illustrate color uniformity resulting from a specific choice of emission spectra, according to some embodiments.
Figure 40A:
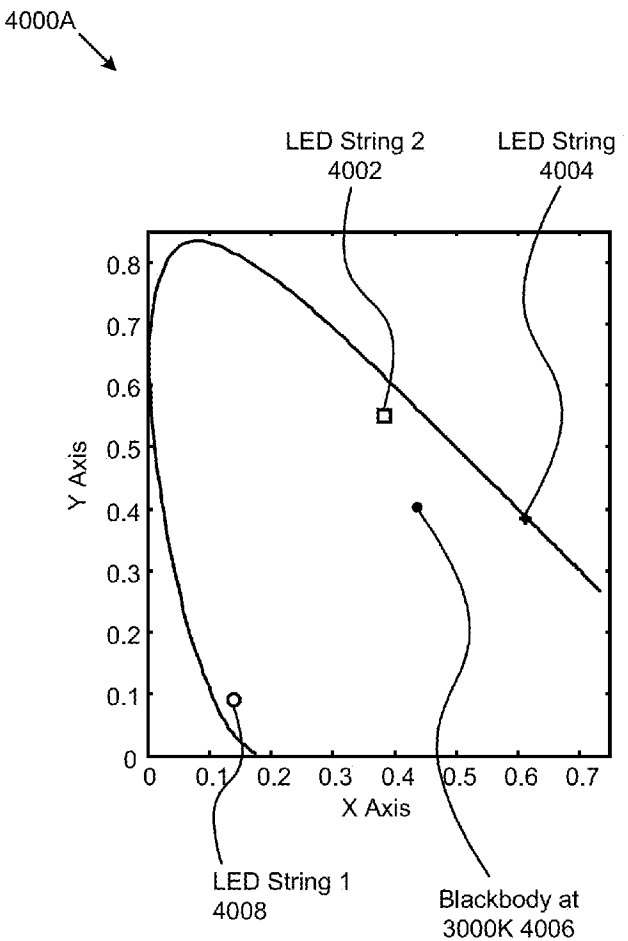

FIG. 40A and FIG. 40B illustrate color uniformity resulting from a specific choice of emission spectra. FIG. 40 relates to FIG. 39, presenting a different choice of emission spectra for the 3 LED groups. In FIG. 40A, the 3 LED groups are relatively far apart in the color space (see locations of LED String 1 4008, LED String 2 4002, and LED String 3 4004). They correspond to a blue LED, a green LED, and a red LED. The corresponding color uniformity in FIG. 40B shows significant color differences: it is larger than Du'v'=10 (see Du'v'>10 4012) and Du'v'=20 (see Du'v'>20 4014) in large regions of the beam.

The comparison of FIGS. 39B and 40B illustrates that color uniformity can be improved if the various LED groups in a lamp have similar color coordinates. For the configuration of FIG. 39A, all LED groups are within Du'v'=70 points of each other and yield a rather color-uniform beam. For the configuration of FIG. 40A, the LED groups are within Du'v'=400 points of each other and yield poor beam color uniformity. In both cases, the chromaticity of a 3000K can be produced however the embodiment of FIG. 39 is preferable in terms of color uniformity.

It should be recognized that in some cases, color uniformity is subjectively less detectable. This is the case for diffuse lamps, such as A-lamps with a diffuse dome which efficiently mixes colors. In such cases, the choice of colors in the LED can be driven by other considerations, such as maximizing the system's efficiency.

Other Embodiments

The foregoing provides a detailed description of a range of embodiments. A selection of such embodiments are presented as follows:

Embodiment 1

An system for coupling LED devices to an AC power source comprising:

a rectifier module being electrically coupled to the AC power source, the rectifier module being configured to provide a rectified output;

a first group of LED devices, the first group of LED devices being electrically coupled to the rectifier module and to receive the rectified output;

a second group of LED devices electrically coupled to the first group of LED devices;

a current monitor module electrically coupled to the first group and second group of LED devices, the current monitor module being configured to determine a first current level using a drawn current level signal associated with the first group of LED devices and a second current level using a reference current level signal associated with the second group of LED devices; and a temperature sensing module electrically coupled to the current monitor module, the temperature sensing module being configured to generate a at least one compensation factor based at least in part on a temperature.

Embodiment 2

The system of embodiment 1, where the first and the second group of LEDs have substantially different emission spectra.

Embodiment 3

The system of embodiment 2, where the system's emission spectrum is modified depending on the amplitude of the system's electrical drive.

Embodiment 4

The system of embodiment 3, where at least two of the system's emission spectra, corresponding to different drive conditions, are within Du'v'=10 points of a blackbody radiator, the two radiators having a CCT difference of at least 300K.

Embodiment 5

The system of embodiment 3, where blackbody spectra in the range 2000-3000K can be produced.

Embodiment 6

The system of embodiment 3, where blackbody spectra in the range 3000-5000K can be produced.

Embodiment 7

The system of embodiment 2, where the first and second group of LEDs have chromaticities differing by less than Du'v'=100 points.

Embodiment 8

The system of embodiment 2, further comprising a third group of LED devices.

Embodiment 9

The system of embodiment 8, where the first and third group of LEDs have chromaticities differing by less than Du'v'=100 points.

While the above is a full description of the specific embodiments, various modifications, alternative constructions and equivalents may be used. Therefore, the above description and illustrations should not be taken as limiting the scope of the present advances which are defined by the appended claims.

What is claimed is:

1. An LED system for coupling to an AC power source comprising:

a rectifier module electrically coupled to the AC power source and configured to provide a rectified output;

a first group of LED devices electrically coupled to the rectifier module and configured to receive the rectified output;

a second group of LED devices electrically coupled to the first group of LED devices;

a current monitor module electrically coupled to the first group and second group of LED devices, the current monitor module being configured to determine a first current level using a drawn current level signal associated with the first group of LED devices and a second current level using a reference current level signal associated with the second group of LED devices; and a temperature sensing module electrically coupled to the current monitor module and configured to generate a at least one compensation factor based at least in part on a temperature.

2. The LED system of claim 1 further comprising a low pass filter electrically coupled to the current monitor module and the temperature sensing module.

3. The LED system of claim 1 wherein the first group of LED devices is electrically coupled to the second group of LED devices in series.

4. The LED system of claim 1 further comprising a first switch and a second switch, the first switch being configured to control the first group of LED devices in response to the compensation factor signal.

5. The LED system of claim 1 wherein the temperature sensing module comprises a divider module.

6. The LED system of claim 1 wherein the temperature sensing module comprises a differential operational amplifier.

7. The LED system of claim 1 wherein the rectifier module is mounted to a printed circuit board.

8. The LED system of claim 1, further comprising an LED submount having a front surface and a back surface, the front surface comprising an inner region and an outer region, the inner region being characterized by a reflectivity of at least 80%, the first and second groups of LED devices being disposed on the inner region.

9. The LED system of claim 8 wherein the first and second group of LED devices are configured for being operable at 100 degrees Celsius or higher.

10. The LED system of claim 8 further comprising a heat sink directly coupled to the back surface of the LED submount, the heat sink being characterized by a thermal emissivity of at least 0.5.

11. The LED system of claim 10 wherein the outer region of the heat sink is substantially non-reflective.

12. The LED system of claim 10 further comprising an MR-16 housing.

13. The LED system of claim 10 wherein the outer region of the heat sink is coated with anodized aluminum material and characterized by a thermal emissivity of at least 0.8.

14. The LED system of claim 10 wherein the heat sink is coated by a non-reflective material, a surface of the heat sink being characterized by an emissivity of at least 0.9.

15. The LED system of claim 10 wherein at least 10% of the front surface area is characterized an emissivity of 0.6 or greater.

16. The LED system of claim 10 further comprising a reflector positioned within an inner region of the front surface.

17. The LED system of claim 10 wherein a thermal resistance from the LED submount to the high-emissivity surface area is less than 8 C/W.

18. The LED system of claim 10 wherein the outer surface of the heat sink is coated by a substantially black coating.

19. An LED system for coupling to an AC power source comprising:

a rectifier module being electrically coupled to the AC power source and configured to provide a rectified output;

a first group of LED devices electrically coupled to the rectifier module and configured to receive the rectified output;

a second group of LED devices electrically coupled to the first group of LED devices;

a current monitor module electrically coupled to the first group and second group of LED devices, the current monitor module being configured to determine a first current level using a drawn current level signal associated with the first group of LED devices and a second current level using a reference current level signal associated with the second group of LED devices;

a temperature sensing module electrically coupled to the current monitor module and configured to generate a at least one compensation factor based at least in part on a temperature; and an LED submount having a front surface and a back surface, the front surface comprising an inner region and an outer region, the inner region being characterized by a reflectivity of at least 80%.

20. An LED system for coupling to an AC power source comprising:

a rectifier module being electrically coupled to the AC power source and configured to provide a rectified output;

a first group of LED devices electrically coupled to the rectifier module and configured to receive the rectified output;

a second group of LED devices electrically coupled to the first group of LED devices;

a current monitor module electrically coupled to the first group and second group of LED devices, the current monitor module being configured to determine a first current level using a drawn current level signal associated with the first group of LED devices and a second current level using a reference current level signal associated with the second group of LED devices;

a temperature sensing module electrically coupled to the current monitor module and configured to generate a at least one compensation factor based at least in part on a temperature;

an LED submount having a front surface and a back surface, the front surface comprising an inner region and an outer region, the inner region being characterized by a reflectivity of at least 80%.the first and second groups of LED devices being disposed on the inner region; and a heat sink coupled to the LED submount, the heat sink being characterized by a thermal emissivity of at least 0.5.

* * * * *